US011102591B2

(12) United States Patent
Petley et al.

(10) Patent No.: US 11,102,591 B2
(45) **Date of Patent: *Aug. 24, 2021**

(54) EAR-WORN ELECTRONIC DEVICE INCORPORATING MOTOR BRAIN-COMPUTER INTERFACE

(71) Applicant: Starkey Laboratories, Inc., Eden Prairie, MN (US)

(72) Inventors: Lauren Petley, Berkeley, CA (US); Swapan Gandhi, El Cerrito, CA (US); Simon Carlile, Berkeley, CA (US); Sahar Akram, Berkeley, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/905,228

(22) Filed: Jun. 18, 2020

(65) Prior Publication Data

US 2020/0322737 A1 Oct. 8, 2020

Related U.S. Application Data

(63) Continuation of application No. 16/744,939, filed on Jan. 16, 2020, now Pat. No. 10,694,299, which is a (Continued)

(51) Int. Cl.
*H04R 25/00* (2006.01)

(52) U.S. Cl.
CPC ..... *H04R 25/505* (2013.01); *H04R 25/30* (2013.01); *H04R 25/554* (2013.01); (Continued)

(58) Field of Classification Search
USPC ..... 381/312, 314, 315, 322, 323, 324, 328, 381/330
See application file for complete search history.

(56) References Cited

U.S. PATENT DOCUMENTS 7,079,966 B2 7/2006 Knoch et al.
8,463,371 B2 6/2013 Guan et al.
(Continued)

FOREIGN PATENT DOCUMENTS

EP 2200342 6/2010
EP 2448477 5/2012
(Continued)

OTHER PUBLICATIONS

Yang, "Distance Metric Learning: A Comprehensive Survey", May 19, 2006, 51 pages.

*Primary Examiner* — Yosef K Laekemariam
(74) *Attorney, Agent, or Firm* — Mueting Raasch Group

(57) ABSTRACT

An ear-worn electronic device comprises a plurality of EEG sensors configured to sense EEG signals from or proximate a wearer's ear. At least one processor is configured to detect, during a baseline period of no wearer movement, EEG signals from the EEG sensors, and detect, during each of a plurality of candidate control movements by the wearer, EEG signals from the EEG sensors. The at least one processor is also configured to compute, using the EEG signals, discriminability metrics for the candidate control movements and the baseline period, the discriminability metrics indicating how discriminable neural signals associated with the candidate control movements and the baseline period are from one another. The at least one processor is further configured to select a subset of the candidate control movements using the discriminability metrics, each of the selected control movements defining a neural command for controlling the ear-worn electronic device by the wearer.

25 Claims, 9 Drawing Sheets

Related U.S. Application Data continuation of application No. 15/827,856, filed on Nov. 30, 2017, now Pat. No. 10,582,316.

(52) U.S. Cl.
CPC ..... *H04R 25/552* (2013.01); *H04R 2225/55* (2013.01); *H04R 2225/61* (2013.01)

(56) References Cited

U.S. PATENT DOCUMENTS

| | | | | |
|---|---|---|---|---|
| 8,478,539 | B2 | 7/2013 | Sieracki | |
| 8,938,301 | B2 | 1/2015 | Hagedorn | |
| 8,971,558 | B2 | 3/2015 | Lunner | |
| 9,025,800 | B2 | 5/2015 | Kidmose | |
| 9,210,517 | B2 * | 12/2015 | Pontoppidan | A61B 5/121 |
| 9,211,078 | B2 * | 12/2015 | Meggiolaro | G06F 3/015 |
| 9,538,934 | B2 | 1/2017 | Ang et al. | |
| 9,814,426 | B2 | 11/2017 | Connor | |
| 10,234,942 | B2 | 3/2019 | Connor | |
| 2002/0077534 | A1 | 6/2002 | Durousseau | |
| 2010/0280338 | A1 | 11/2010 | Chou | |
| 2012/0226185 | A1 | 9/2012 | Chung et al. | |
| 2016/0103487 | A1 | 4/2016 | Crawford et al. | |
| 2016/0119726 | A1 | 4/2016 | Pontoppidan et al. | |
| 2016/0345901 | A1 | 12/2016 | Connor | |

FOREIGN PATENT DOCUMENTS

| | | |
|---|---|---|
| EP | 2454892 | 5/2012 |
| EP | 2667638 | 11/2013 |
| WO | 2012/153965 | 11/2012 |
| WO | 2014/069996 | 5/2014 |
| WO | 2015/090430 | 6/2015 |

* cited by examiner

EAR-WORN ELECTRONIC DEVICE INCORPORATING MOTOR BRAIN-COMPUTER INTERFACE

RELATED PATENT DOCUMENTS

This application is a continuation of U.S. application Ser. No. 16/744,939, filed Jan. 16, 2020, to issue as U.S. Pat. No. 10,694,299, which is a continuation of U.S. application Ser. No. 15/827,856 filed on Nov. 30, 2017, now U.S. Pat. No. 10,582,316 which is incorporated herein by reference in its entirety.

TECHNICAL FIELD

This application relates generally to ear-worn electronic devices, including hearing devices, hearing aids, personal amplification devices, and other hearables.

BACKGROUND

Hearing devices provide amplified sound for the wearer. Some examples of hearing devices are headsets, hearing aids, in-ear monitors, cochlear implants, bone conduction devices, and personal listening devices. For example, hearing aids provide amplification to compensate for hearing loss by transmitting amplified sounds to the ear canals. There are ongoing efforts to reduce the size of hearing devices, which makes it difficult for wearers to control their hearing devices by manual actuation of a limited number of buttons. The small size and limited number of control buttons limits the number of functions that can be implemented by a hearing device.

SUMMARY

Embodiments of the disclosure are directed to a method implemented using an ear-worn electronic device configured to be worn by a wearer. The method comprises detecting, during a baseline period of no wearer movement, EEG signals from or proximate an ear of the wearer using the ear-worn electronic device. The method also comprises detecting, during each of a plurality of candidate control movements by the wearer, EEG signals from or proximate the ear of the wearer using the ear-worn electronic device. The method further comprises computing, using a processor operating on the EEG signals, discriminability metrics for the candidate control movements and the baseline period, the discriminability metrics indicating how discriminable neural signals associated with the candidate control movements and the baseline period are from one another. The method also comprises selecting a subset of the candidate control movements using the discriminability metrics, each of the selected control movements defining a neural command for controlling the ear-worn electronic device by the wearer.

Embodiments are also directed to a method of processing the EEG signals associated with each of the selected control movements and the baseline period using a plurality of disparate data analysis pipelines implemented by the processor. Each of the data analysis pipelines is configured to translate features of the EEG signals to device control parameters for controlling the ear-worn electronic device in response to the selected control movements. The method also comprises selecting one of the plurality of data analysis pipelines or a weighted combination of the data analysis pipelines that most effectively translates features of the EEG signals to device control parameters. The method further comprises controlling the ear-worn electronic device using the selected control movements processed by the selected data analysis pipeline or the weighted combination of data analysis pipelines.

Embodiments are directed to a system comprising an ear-worn electronic device configured to be worn by a wearer. The ear-worn electronic device comprises a plurality of EEG sensors configured to sense EEG signals from or proximate an ear of the wearer. The system also comprises at least one processor configured to detect, during a baseline period of no wearer movement, EEG signals from the EEG sensors, and detect, during each of a plurality of candidate control movements by the wearer, EEG signals from the EEG sensors. The at least one processor is also configured to compute, using the EEG signals, discriminability metrics for the candidate control movements and the baseline period, the discriminability metrics indicating how discriminable neural signals associated with the candidate control movements and the baseline period are from one another. The at least one processor is further configured to select a subset of the candidate control movements using the discriminability metrics, each of the selected control movements defining a neural command for controlling the ear-worn electronic device by the wearer.

Embodiments are also directed to a system comprising at least one processor configured to process the EEG signals associated with each of the selected control movements and the baseline period using a plurality of disparate data analysis pipelines implemented by the processor. Each of the data analysis pipelines is configured to translate features of the EEG signals to device control parameters for controlling the ear-worn electronic device in response to the selected control movements. The at least one processor is also configured to select one of the plurality of disparate data analysis pipelines or a weighted combination of the data analysis pipelines that most effectively translates features of the EEG signals to device control parameters.

The above summary is not intended to describe each disclosed embodiment or every implementation of the present disclosure. The figures and the detailed description below more particularly exemplify illustrative embodiments.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
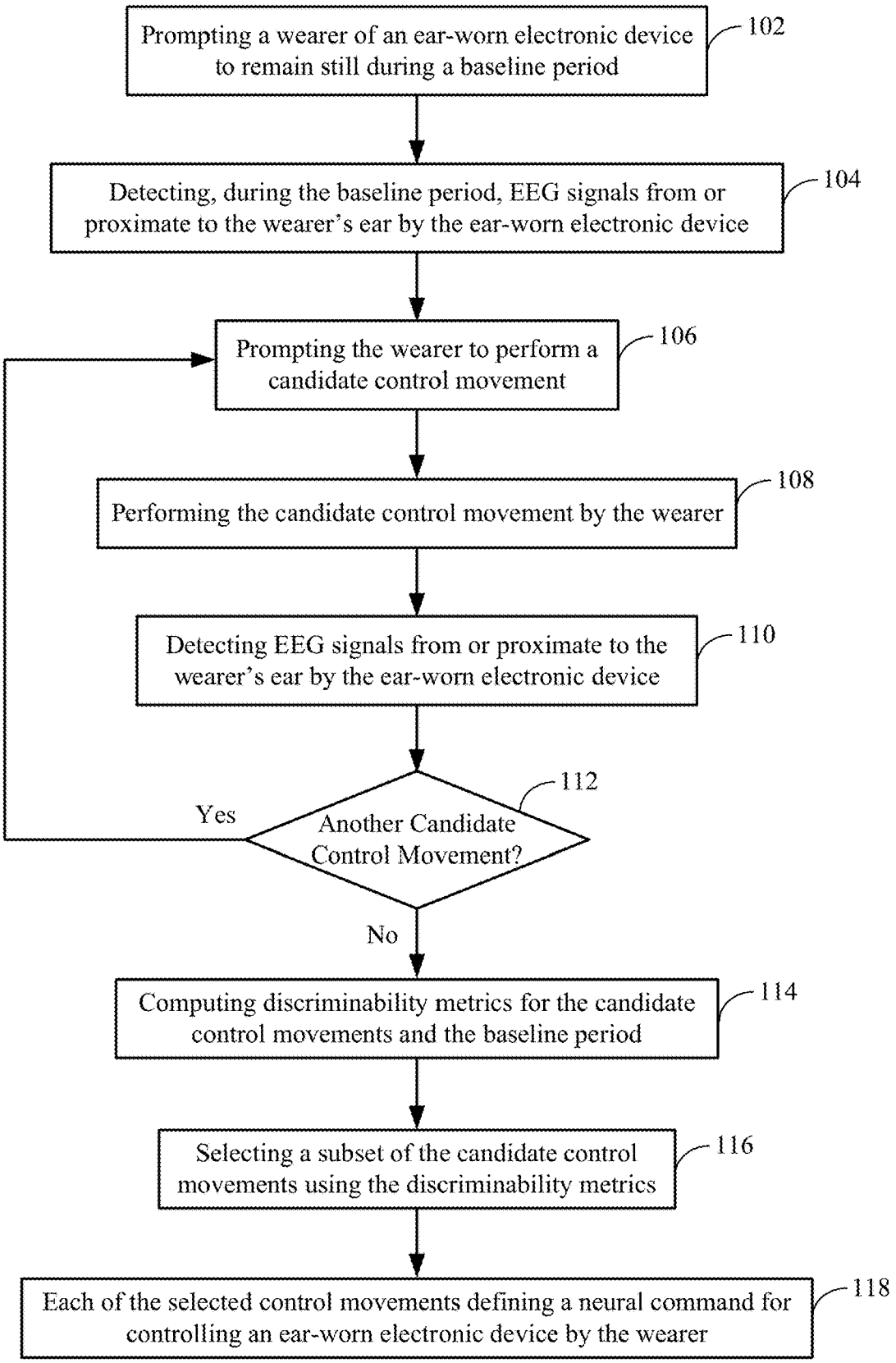
FIG. 1 shows a method of selecting from among a wearer's candidate control movements for a motor BCI of an ear-worn electronic device in accordance with various embodiments.

It is understood that the embodiments described herein may be used with any ear-worn electronic device without departing from the scope of this disclosure. The devices depicted in the figures are intended to demonstrate the subject matter, but not in a limited, exhaustive, or exclusive sense. It is also understood that the present subject matter can be used with a device designed for use in or on the right ear or the left ear or both ears of the wearer.

The term ear-worn electronic device of the present disclosure refers to a wide variety of ear-level electronic devices that can aid a person with impaired hearing. The term ear-worn electronic device also refers to a wide variety of devices that can produce optimized or processed sound for persons with normal hearing. Ear-worn electronic devices of the present disclosure include hearables (e.g., wearable earphones, headphones, in-ear monitors, earbuds, virtual reality headsets), hearing aids (e.g., hearing instruments), cochlear implants, and bone-conduction devices, for example. Ear-worn electronic devices include, but are not limited to, behind-the-ear (BTE), in-the-ear (ITE), in-the-canal (ITC), invisible-in-canal (IIC), receiver-in-canal (RIC), receiver-in-the-ear (RITE) or completely-in-the-canal (CIC) type hearing devices or some combination of the above. Throughout this disclosure, reference is made to an "ear-worn electronic device," which is understood to refer to a system comprising a left ear device or a right ear device or a combination of a left ear device and a right ear device.

Ear-worn electronic devices and other wearable devices have limited space for buttons and other physical controls. A brain-computer interface (BCI) is a technology that allows users to control a machine using voluntary or involuntary modulations of their brainwaves. A BCI can offer users greater flexibility to control devices with limited physical controls.

Among the possible neural responses that can be used in a BCI, the responses that are associated with motor planning, imagery, and execution are particularly useful because they are large and robust, and the spatial locations of their generators in the brain are very well known. Motor execution refers to a movement that progresses fully from intention to action. Motor imagery refers to a movement that is fully imagined, with no intention to actually perform the movement. Successful motor imagery focuses on the kinesthetic aspects of the imagined movement (the bodily sensations of movement) rather than the visual aspect of seeing one's limbs move. Motor planning refers to the pre-action stages of an executed movement, but is described herein as a distinct entity because intervention between the intention and action stages of an executed movement can allow that movement to be aborted.

Motor BCIs extract their input signals from the electroencephalogram (EEG). The main signals that are typically used are sensorimotor rhythms, known as mu rhythms, which are generated in the somatosensory and motor cortices of the brain, referred to together as the sensorimotor cortex. However, some motor BCIs use slow potentials, known variously as the lateralized readiness potential, readiness potential, Bereitschaftspotential, or motor-related cortical potential.

To date, motor BCIs have primarily been developed for use in the domain of rehabilitation and prosthetics for patients with strokes, paralysis, or amputations. In these cases, bulky solutions such as electrode caps or invasive, intracranial recordings are a reasonable solution. Although relatively affordable and portable consumer solutions in the form of headsets have been created for BCIs, researchers have not yet implemented a motor BCI in an ultra-portable form that would be acceptable as a wearable technology for able-bodied consumers. Embodiments of the disclosure are directed to an ultra-portable motor BCI that is wearable in and/or around the ear(s), which provide proximity to the brain without the interference of hair. Embodiments of the disclosure are directed to various techniques for implementing a motor BCI using ear-level sensors.

In comparison to electrode caps, ear-level sensors are disadvantageously placed with regards to the location of primary sensorimotor cortices, and a small footprint around the ear(s) provides very little space for sensors. This makes detecting and differentiating the neural activity associated with motor planning, imagery, or execution difficult and increases the need to produce and extract the most robust neural signals possible to use as inputs to the motor BCI. Embodiments of the disclosure are directed to techniques that address these and other challenges.

An important factor in the design of a motor BCI (sensorimotor rhythm BCI) for use in an ear-worn electronic device is the selection of a user task that maximizes the detectability and distinguishability of the neural responses that are evoked. Embodiments are directed to guiding the wearer to plan, imagine, or execute body movements to provide a robust signal for the motor BCI of an ear-worn electronic device during an initialization phase. The wearer's controls developed during the initialization phase comprise a set of movements, with each movement serving as a different command to the ear-worn electronic device. In contrast to conventional approaches, which commonly force the user to learn a pre-defined set of control movements, embodiments of the disclosure tailor the set of control movements to the wearer based on data that is obtained during the initialization phase.

During the initialization phase, a wearer of an ear-worn electronic device which incorporates a motor BCI is instructed to perform a variety of movements and an optimal subset of these movements is selected to serve as the wearer's command movements. The advantages of this approach are twofold. First, by selecting movements that the wearer is proficient in, the approach reduces the need for user training. Second, the approach addresses the disadvantageous placement of sensors at ear level by biasing command movement selection to those that register best at the ear, given the wearer's unique anatomy.

To further address the need for robust neural signals that can be more readily detected at or around the ear(s), the motor BCI of the ear-worn electronic device is not limited to imagined movements, as is the case for conventional motor BCIs developed for consumer applications. According to various embodiments, a motor BCI of an ear-worn electronic device is configured to use any combination of planned, imagined, or executed movements as control signals. For example, the motor BCI can be configured to use a combination of imagined and planned movements as control signals. In another example, the motor BCI can be configured to use a combination of imagined and executed movements as control signals. In a further example, the motor BCI can be configured to use a combination of imagined, planned, and executed movements as control signals. It is noted that some embodiments can be implemented to use only imagined movements as control signals.

In accordance with embodiments that use executed movements as control signals, an executed movement can be augmented by involving robust sensory stimulation that provides strong neural activation to differentiate the neural response of interest from other movements. For example, executed movements involving touching or pressure on the finger tips, lips or tongue (somatosensory stimulation), which have particularly large sensory representations in the human cortex. According to various embodiments, the selection of whether to use planned, imagined, or executed movements, or any combination thereof, can depend on a plurality of factors including, but not limited to, command movement detectability, discriminability, repeatability, user skill, and user preference.

The sequence of neural events that unfold with planned, imagined, or executed movements can be broadly described as follows. When movements (planned, imagined, or executed) are self-initiated, approximately two seconds prior to movement, there is a reduction in upper alpha/lower beta power in Rolandic regions contralateral (i.e., on the opposite side of the body) to the executed movement, which becomes bilateral immediately before movement execution. This transient reduction in band power is known as an event-related desynchronization (ERD). Against this background of alpha ERD, shortly before movement onset and during execution, an increase in gamma power occurs. Such a transient power increase is known as an event-related synchronization (ERS). Approximately the first second of data following termination of a voluntary movement contains another ERS, this time in the beta band, which occurs against the continuing background of alpha ERD. It is noted that this sequence of events is subject to variation. The frequency range within the beta band that shows the largest ERS can differ between body parts, with finger movements located between 16 and 21 Hz and foot movements located between 19 and 26 Hz, for example. Unlike alpha ERD, which manifests first contralaterally and then bilaterally, beta and gamma ERS are restricted to the contralateral side. There is evidence that EEG bandpower fluctuations in the combined alpha/beta range are more lateralized for imagined movements than executed ones. The motor BCI of an ear-worn electronic device can be configured to process EEG signals to detect at least alpha and beta power fluctuations and translate these power fluctuations into control signals for controlling the ear-worn electronic device.

FIG. 1 shows a method of selecting a wearer's candidate control movements for a motor BCI of an ear-worn electronic device in accordance with various embodiments. The method shown in FIG. 1 involves prompting 102 a wearer of an ear-worn electronic device to remain still during a baseline period. For example, the wearer may be prompted not to move and to avoid thinking about (e.g., imagining or planning) moving a part of wearer's body. The method involves detecting 104, during the baseline period, EEG signals from or proximate to the wearer's ear by the ear-worn electronic device. The EEG signals associated with the baseline period are stored.

The method also involves prompting 106 the wearer of the ear-worn electronic device to perform a candidate control movement. The candidate control movement is then performed 108 by the wearer. The method involves detecting 110 EEG signals from or proximate to a wearer's ear by the ear-worn electronic device. The EEG signals associated with the candidate control movement are stored. A check is made 112 to determine if another candidate control movement is to be performed by the wearer. If so, the processes shown in blocks 106-110 are repeated for the next candidate control movement. At the conclusion of decision block 112, the EEG signals for the baseline period and multiplicity of candidate control movements are available for further processing.

The method of FIG. 1 further involves computing 110 discriminability metrics for the candidate control movements, both versus each other and versus a non-movement baseline period. More particularly, a plurality of indices can be computed to express how discriminable the candidate control movements are from one another. Computing the discriminability metrics can involve computing distance metrics for the candidate control movements. It is widely understood in brain-computer interfacing that distance metrics are computed by mapping EEG feature sets, or higher-level feature sets that are extracted from the EEG, to a topological space and then measuring the distance between the feature sets that are associated with different brain states. For the purpose of a motor BCI, the brain states of interest are different control movements and the baseline (non-movement) state. For example, the distance metrics can be computed based on alpha desynchronization power of the EEG signals and the distribution of power fluctuations on the head. By way of further example, the distance metrics can be computed based on the frequency of maximum modulation in the alpha and beta ranges. By way of further example, the use of Riemannian geometry, which permits the measurement of distances between covariance matrices, is popular in modern BCI research. In this methodology, the EEG data samples are not mapped for distance measurement, but rather covariance matrices that are extracted from the EEG by comparing different sets of EEG data samples to each other, are mapped to a Riemannian geometric space. Distances can then be measured between these covariance matrices.

Computing discriminability metrics can also involve classification by one or more classifiers, for example using a linear discriminant algorithm. Cross-validation of classification algorithms yields both sensitivity and specificity values which can be used as discriminability metrics, and may be weighted differently depending on the goals of the motor BCI. For example, the weightings chosen for the sensitivity and specificity outputs of a classifier when computing the distance metrics (for control movement selection) may be optimized for different applications. For example, for changing a memory setting of the ear-worn electronic device, it may be more acceptable to miss a control movement than to erroneously detect that the control movement has been issued. This application would therefore require lower sensitivity and higher specificity. The accuracy values that are obtained from classification can also be used as discriminability metrics and the results of many pairwise classifications can be expressed as a confusion matrix. In some embodiments, the discriminability metrics can comprise a weighted combination of distance metrics and classifier outputs. In other embodiments, the discriminability metrics can be used to select the subset of candidate control movements that will be used for future interaction between the wearer and the ear-worn electronic device.

The method of FIG. 1 also involves selecting 116 a subset of the candidate control movements using the discriminability metrics. This subset of candidate control movements include those movements (planned, imagined, or executed) of the wearer that have been determined to be most discernible from one another and from non-movement based on the discriminability metrics. Each of the selected control movements defines 118 a neural command for controlling the ear-worn electronic device by the wearer. In some embodiments, selecting 116 a subset of the candidate control movements can involve selecting candidate control movements preferred by the wearer (identified via a wearer preference input). In such embodiments, discriminability metrics can be combined with wearer preferences to select the subset of candidate control movements to be used for future interaction between the wearer and the ear-worn electronic device.

Figure 2:
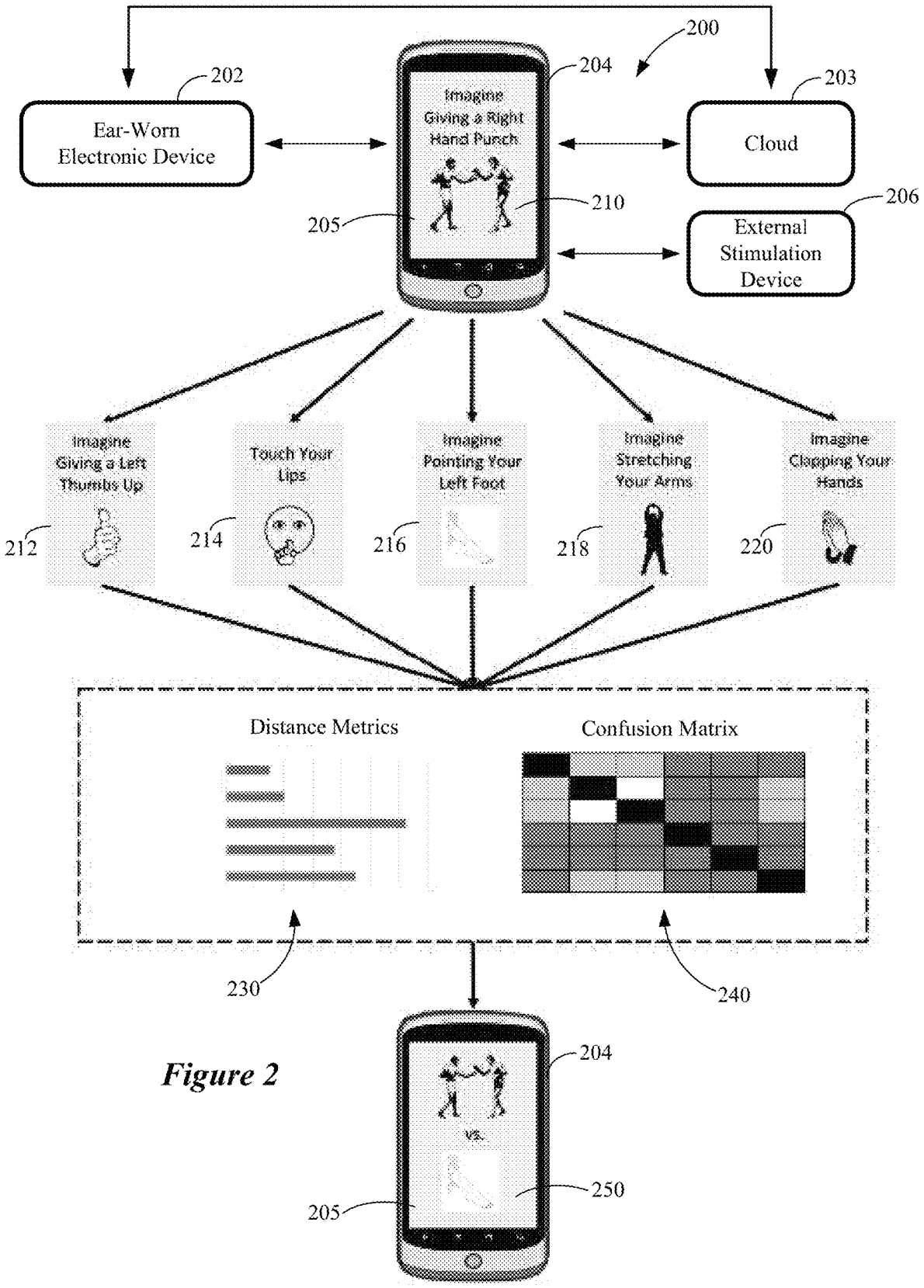
FIG. 2 shows a system for selecting from among a wearer's candidate control movements for a motor BCI of an ear-worn electronic device in accordance with various embodiments.

FIG. 2 shows a system for selecting a wearer's candidate control movements for a motor BCI of an ear-worn electronic device in accordance with various embodiments. The system 200 illustrated in FIG. 2 can be configured to implement the method shown in FIG. 1. The system 200 shown in FIG. 2 includes an ear-worn electronic device 202 communicatively coupled to a processor-based system 204. The ear-worn electronic device 202 can be communicatively coupled to the cloud 203 directly or via the processor-based system 204. The processor-based system 204 can be a smartphone, a tablet, a laptop, or a desk-top computer, for example. In some embodiments, the processor-based system 204 cooperates with the ear-worn electronic device 202 to process EEG signals and select the wearer's candidate control movements. In other embodiments, the processor-based system 204 cooperates with the ear-worn electronic device 202 and processors of the cloud 203 to process EEG signals and select the wearer's candidate control movements.

The following is a non-limiting example of the user initialization phase implemented by the system 200 shown in FIG. 2. Initially, the wearer of the ear-worn electronic device 202 is prompted to produce a variety of candidate control movements. For example, a candidate control movement is graphically and/or textually presented on a display 205 of the processor-based system 204. As each of the candidate control movements is being performed by the wearer, EEG signals are detected by the ear-worn electronic device 202. After completion of the candidate control movement, the EEG signals acquired by the ear-worn electronic device 202 are communicated to the processor-based system 204 and stored in a memory of the processor-based system 204. The process of presenting a candidate control movement on the display 205, acquiring EEG signals by the ear-worn electronic device 202, and storage of the EEG signals by the processor-based system 204 is repeated for each of the candidate control movements. The EEG signals acquired by the ear-worn electronic device 202 can also be transmitted to the cloud 203. In yet another embodiment, the initialization phase can involve somatosensory stimulation of body parts alone or in conjunction with planned or imagined movements, using an external stimulation device 206, such as a neuroelectric or vibrotactile stimulator.

In the illustrative example shown in FIG. 2, the candidate control movements include an imagined right-hand punch (IR punch) 210, an imagined left-hand thumbs up (IL Thumbs Up) 212, touching the lips (Touch Lips) 214, imagining pointing the left foot (IL Foot Point) 216, imagining stretching both arms (I Arm Stretch) 218, and imagining clapping the hands (I Clap) 220. It is understood that many other candidate control movements can be used in addition to or instead of the set shown in FIG. 2.

Following user production of the candidate control movements, the system 200 computes discriminability metrics using the EEG signals stored in the processor-based system 204. The discriminability metrics express how discriminable the candidate control movements are from one another. As was discussed previously, the discriminability metrics that are computed by the system 200 can include distance metrics 230 based on EEG features such as the peak frequency of alpha or beta modulation. The discriminability metrics that are computed by the system 200 can also include classification accuracies, illustrated here as a confusion matrix 240.

In some embodiments, the processor-based system 204 is configured to compute discriminability metrics, including distance metrics 230 and the confusion matrix 240. In other embodiments, the EEG signals stored in the processor-based system 204 are communicated to the cloud 203, and processors of the cloud 203 are configured to compute the distance metrics 230 and the confusion matrix 240. The results from processing in the cloud 230 can be transmitted back to the processor-based system 204 or directly back to the ear-worn device 202.

Figure 3:
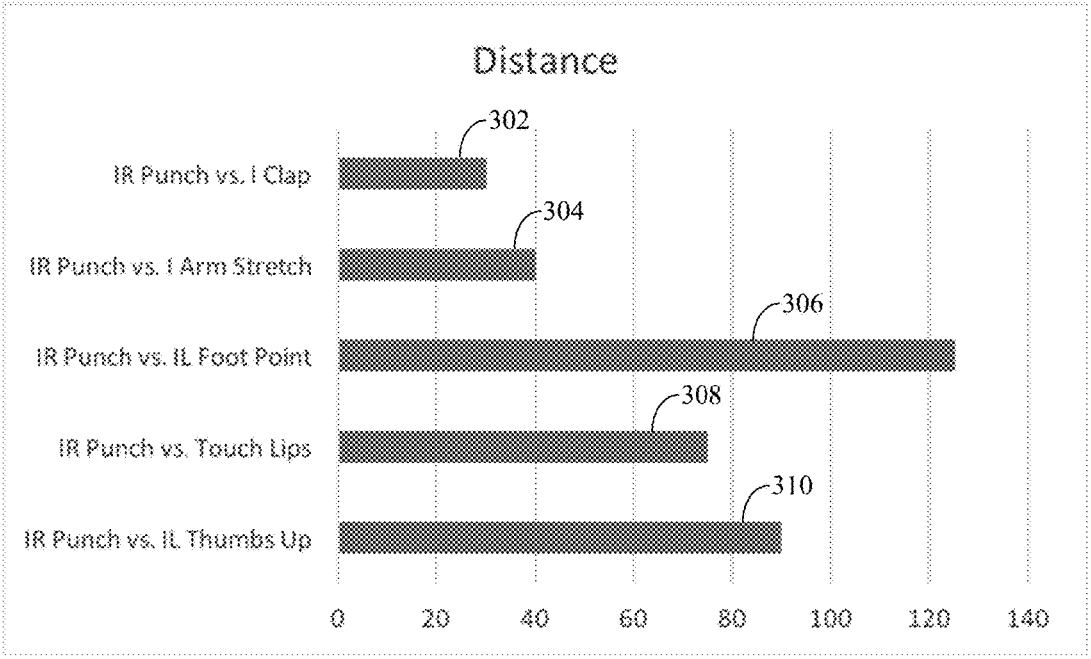
FIG. 3 shows representative distance metrics for various combinations of candidate control movements in accordance with various embodiments.

FIG. 3 shows representative distance metrics for various combinations of the candidate control movements that involve an IR punch. Distance metric 302, having a distance value of about 30, represents the movement combination involving the imagined right-hand punch (IR Punch vs. I Clap) that is least discernible by the system 200. Distance metric 306, having a distance value of about 125, represents the combination involving IR punch (IR Punch vs. IL Foot Point) that is most discernible by the system 200. Other distance metrics 304, 308, and 310 have distance values between the least and most discernible movement combinations 302 and 306.

Figure 4:
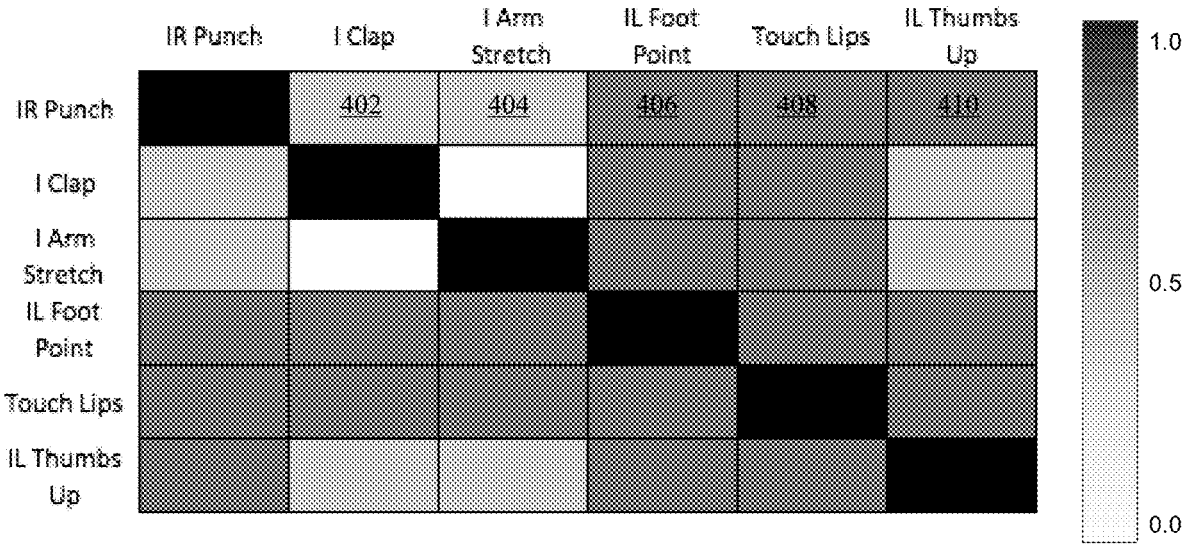
FIG. 4 shows a confusion matrix indicating how accurately various candidate control movements are classified in accordance with various embodiments.

FIG. 4 shows a representative confusion matrix for various pairwise classifications of candidate control movements. Each cell represents the classification accuracy of this contrast by its color (shown in grayscale in FIG. 4). The light coloration of the cells for an IR punch versus I Clap 402, or an I Arm Stretch 404 indicates below-chance classification accuracy around 0.4. The dark coloration of the cells for an IR punch versus an IL Foot Point 406, Touch Lips 408, or IL Thumbs Up 410 movement indicates high classification accuracy around 0.9. Black cells on the diagonal indicate no value because the control movement would be contrasted with itself.

In some embodiments, a threshold can be established, such as a distance value of 60, to distinguish between acceptable and unacceptable distance metric values. The candidate control movements associated with distance metric values in excess of the threshold can form a selected subset of the candidate control movements that define neural commands for controlling the ear-worn electronic device 202. For example, the selected subset of candidate control movements based on the distance metrics shown in FIG. 3 can include IR Punch, IL Foot Point, Touch Lips, and IL Thumbs Up. The candidate control movements I Clap and I Arm Stretch can be excluded from the subset of selected candidate control movements. In another example, a classification accuracy of 0.8 could be established as a threshold, by which the same subset of candidate control movements, IR Punch, IL Foot Point, Touch Lips, and IL Thumbs Up would be identified. By way of a further example, the discriminability threshold could require a weighted contribution of distance and classification measures, for example (0.8*distance)/100 and 0.2*classification, with a threshold of 1.1, which would only yield IR Punch and IL Foot Point as the best subset of candidate control movements.

Following the computation of the discriminability metrics, the wearer is informed which control signals should be optimal for them. For example, images of the IR Punch versus IL Foot Point 250 can be presented on the display 205 of the processor-based system 204, as shown at the bottom of FIG. 2. In some embodiments, the wearer may be given the option to reject a selected control movement. In this case, the wearer may be presented with more candidate control movements in order of discriminability. The wearer may then be presented with the selected subset of candidate control movements. The wearer may be given the option to accept or reject one or more of the selected subset of candidate control movements, which may be based on wearer skill and preference. Wearer decisions can be assisted by providing a trial of motor BCI operation using the selected subset of candidate control movements. It is noted that threshold criteria can be applied to the discriminability metrics to identify a larger subset of optimal control movements to support more complex user interfaces (e.g., multiclass brain-computer interfacing).

As was discussed above, each of the selected control movements determined by the method and system shown in FIGS. 1 and 2 defines a neural command for controlling the ear-worn electronic device 202 by the wearer. For purposes of illustration, and not of limitation, a selected control movement can define a neural command for controlling a beamforming feature of the ear-worn electronic device 202. A beamforming feature addresses a problem that the wearer's desired sound source may not be in front of the wearer's head, and that a conventional ear-worn electronic device may rely on a fixed, forward-facing directionality of the device's microphones. The motor BCI of the ear-worn electronic device 202 can steer the beamformer in space in response to wearer control movements. For example, the wearer can imagine right and left hand movements to steer the beamformer as desired in space.

Changing memory settings of the ear-worn electronic device 202 can be implemented by the motor BCI of the device 202. Memory settings allow the wearer to customize the ear-worn electronic device 202 based on the environment, such as by modifying the frequency shaping and/or compression characteristics of the device 202. For example, the wearer can imagine a foot movement to switch between memory settings (e.g., memory setting, 1, 2, 3, etc.). A conventional ear-worn electronic device requires actuation of a physical button by the wearer. The problem with this approach is that the wearer may lack the dexterity to press the button, or button pressing may draw unwanted attention to the device 202 (e.g., in the case of a hearing aid).

The motor BCI of the ear-worn electronic device 202 can be configured to allow the wearer to select between omnidirectional and directional microphone modes. For example, the wearer can touch his or her lips with a finger to specify the desired level of directionality. In a conventional ear-worn electronic device, a directional mode may always be active except in very quiet environments. Loudness or quietness of an acoustic scene does not necessarily predict the user's listening goals. For example, the wearer may desire more environmental awareness even in a loud scene.

The motor BCI of the ear-worn electronic device 202 can be configured to allow the wearer to control direct streaming to the device 202 from a streaming source, such as a smartphone. For example, the user can imagine right and left hand movements to turn the volume up and down. The user can imagine a foot movement to advance to the next music track. The user may perform more complex operations using the motor BCI of the ear-worn electronic device 202. For example, the ear-worn electronic device 202 may be communicatively coupled to a smartphone which receives a call while the user is listening to music being streamed from the smartphone. The user can imagine making a tongue movement to take the call and pause the music. At the conclusion of the call, the user can imagine making a fist with both hands to terminate the call and resume listening to the music. Using a conventional ear-worn electronic device (one not equipped with a motor BCI), the wearer would have to use his or her smartphone to manually control streaming (e.g., take a call, advance between audio tracks, control volume).

Figure 5:
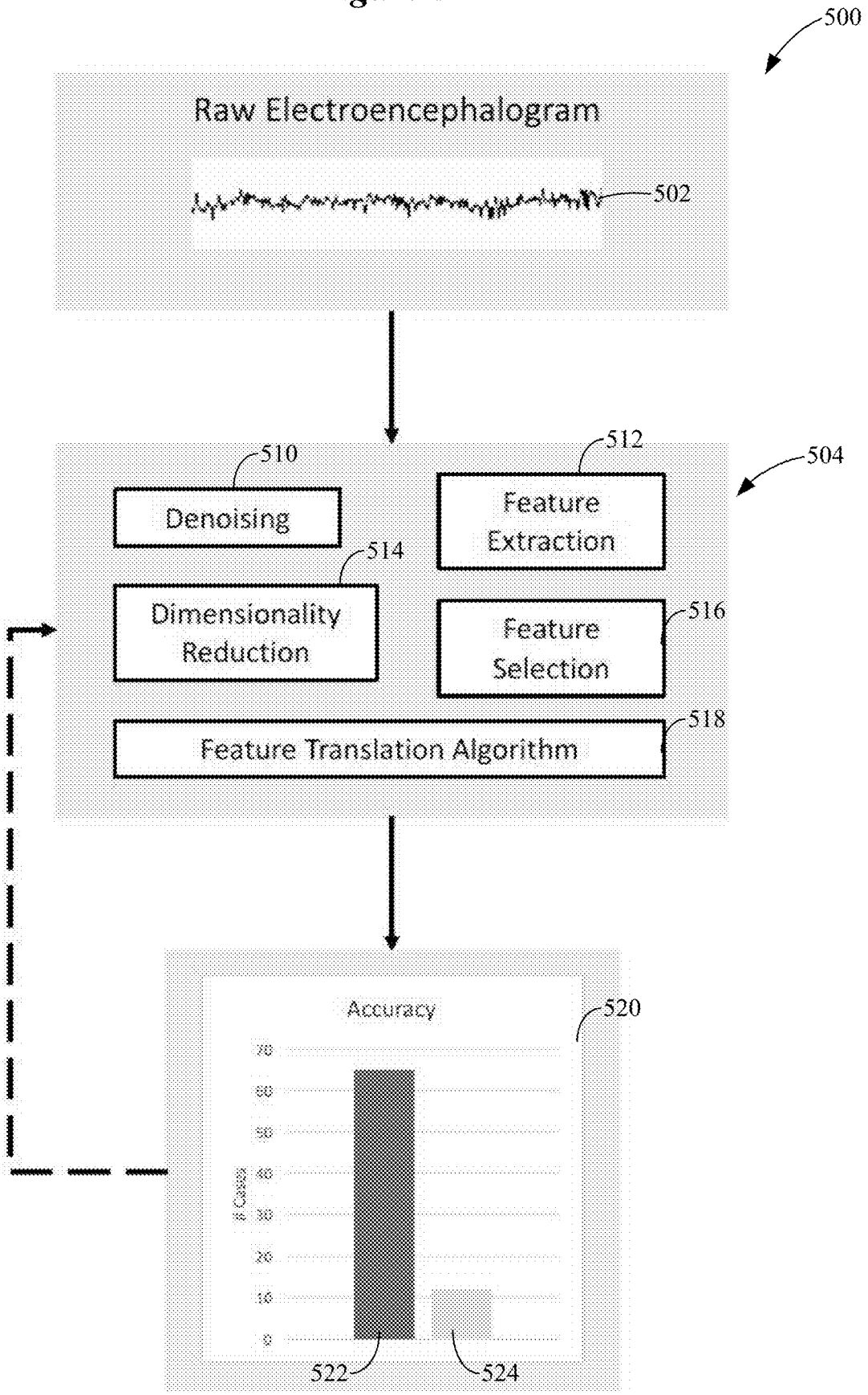
FIG. 5 shows a generalized data analysis pipeline configured to classify neural signals corresponding to a control movement planned, imagined, or executed by a wearer of an ear-worn electronic device in accordance with various embodiments.

The embodiments discussed hereinabove are directed to selecting optimal control movements that are tailored to the wearer and provide robust signals for the motor BCI of an ear-worn electronic device. To further address the need for robust neural signals for the motor BCI, additional embodiments are directed to customization of the data analysis pipeline that processes the neural signals (EEG signals) corresponding to a set of wearer movements that have been selected to control the ear-worn electronic device. Customization of the data analysis pipeline is implemented during a learning phase. FIG. 5 shows a generalized data analysis pipeline configured to classify neural signals corresponding to a control movement planned, imagined, or executed by a wearer of an ear-worn electronic device. A person of ordinary skill in the art will recognize that with sufficient computing power the initialization phase of control movement selection and the learning phase of pipeline selection can be combined to optimize both of these parameters at once. For example, discriminability metrics (typically computed during the initialization phase) can include the outputs of a plurality of disparate analysis pipelines (typically used during the learning phase) which will be selected from for future interaction between the wearer and the ear-worn electronic device.

The system 500 shown in FIG. 5 obtains an EEG signal 502 from a number of EEG sensors of the ear-worn electronic device. The EEG signal 502 is processed by a data analysis pipeline 504 configured to translate features of the EEG signal 502 to device control parameters. The data analysis pipeline 504 includes a denoising stage 510 configured to remove artifacts and isolate the signal of interest. A feature extraction stage 512 operates on the denoised EEG signal 502 to obtain measurements of the desired signal elements (e.g., alpha and beta power fluctuations). As will be described hereinbelow, many different algorithms and combination of algorithms can be used to perform feature extraction.

A dimensionality reduction stage 514 and a feature selection stage 516 operate on the extracted features of the EEG signal 502 to decrease the number of measurements that are to be used. The features that survive this process are used to select a feature translation algorithm 518. In some embodiments, the feature translation algorithm 518 provides discrete values (e.g. classification). In other embodiments, the feature translation algorithm 518 provides a continuous mapping of neural measurements onto some dimension of device control (e.g., via linear or non-linear equations/models). The delineation of elements of the data analysis pipeline 504 shown in FIG. 5 is helpful to understand the underlying analysis but many approaches may blur or blend the boundaries between these elements. For example, a deep neural network encompasses all of the elements of the data analysis pipeline 504 shown in FIG. 5.

Following calculation of the feature translation algorithm 518, the calculation is validated using metrics by a validator 520. The validator 520 may be configured to validate the calculation of the feature translation algorithm 518 based on classification accuracy. In this illustrative example, the validator 520 uses hit rate 522 (percentage of accurate classifications in which a response is classified as being present when it is in fact present) and false alarm rate 524 (percentage of inaccurate classifications in which a response is classified as being present when it is in fact absent). As illustrated, the feature translation algorithm 518 has a hit rate 522 of about 65% and a false alarm rate 524 of about 11%. If the performance of the feature translation algorithm 518 is insufficient, the process shown in FIG. 5 can be reiterated and the analysis refined to produce better results. This discussion of FIG. 5 facilitates an understanding of the embodiments illustrated in FIGS. 6-9, which involve a multiplicity of data analysis pipelines.

Figure 6:
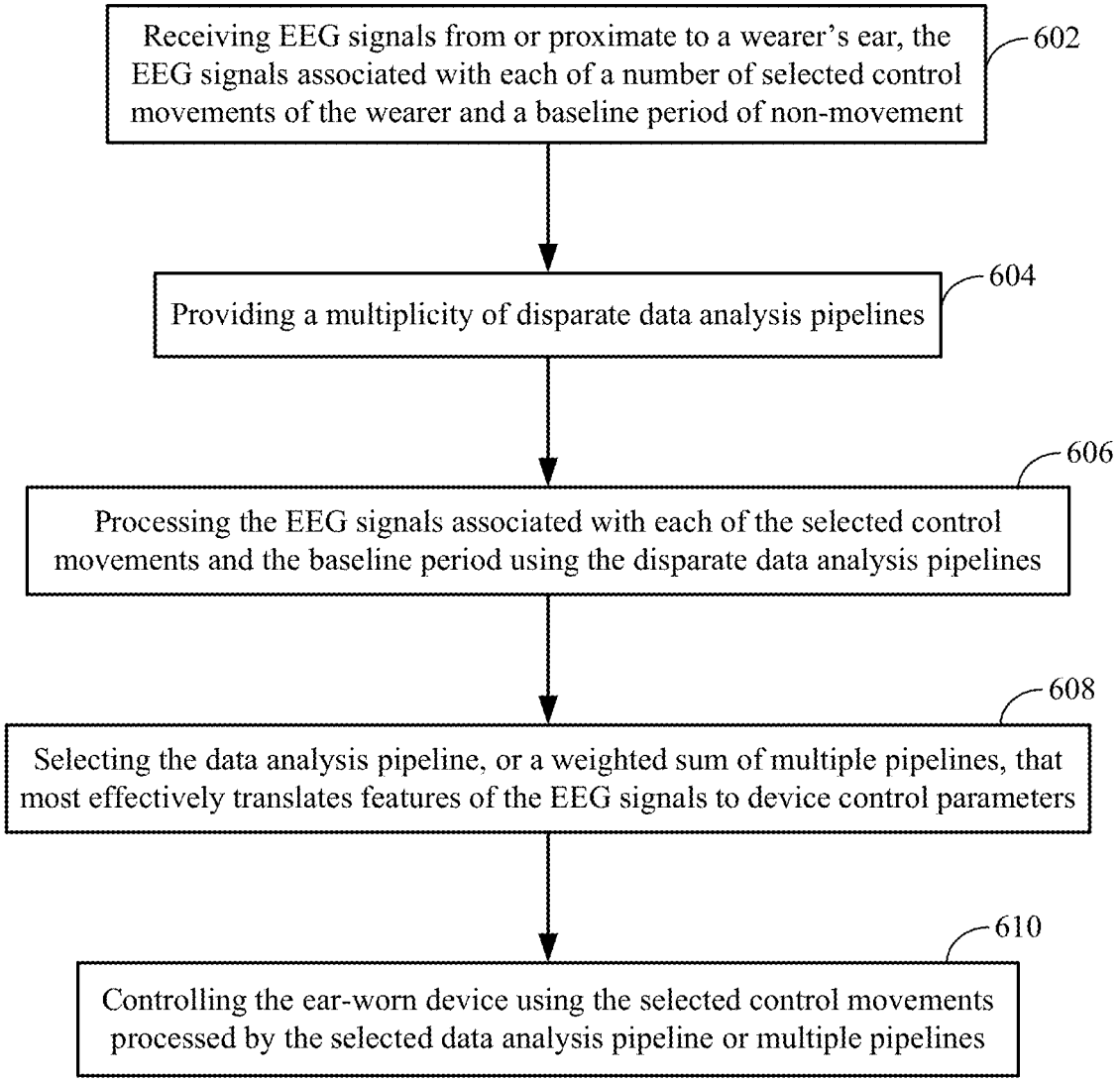
FIG. 6 illustrates a representative learning phase involving a multiplicity of disparate data analysis pipelines in accordance with various embodiments.

FIG. 6 illustrates a representative learning phase involving a multiplicity of disparate data analysis pipelines in accordance with various embodiments. The method shown in FIG. 6 involves receiving 602 EEG signals from or proximate to a wearer's ear. The EEG signals are associated with each of a number of selected control movements of the wearer and a baseline period of non-movement of the wearer. The method involves providing 604 a multiplicity of disparate data analysis pipelines. The method also involves processing 606 the EEG signals associated with each of the selected control movements and the baseline period using the disparate data analysis pipelines. The method further involves selecting 608 the data analysis pipeline, or a weighted sum of multiple pipelines, that most effectively translates features of the EEG signals to device control parameters. The features of the EEG signals translated to device control parameters can include one or more of temporal, spectral, and spatial features of the EEG signals. In some embodiments, at least one of the data analysis pipelines or the weighted combination of the data analysis pipelines is configured to translate features of the EEG signals to device control parameters in a discrete mode. Alternatively, or in addition, at least one of the data analysis pipelines or the weighted combination of the data analysis pipelines is configured to translate features of the EEG signals to device control parameters in a continuous mode. In further embodiments, selecting one of the plurality of data analysis pipelines or the weighted combination of data analysis pipelines can be based on performance metrics that are yielded using a combination of the wearer's EEG signals and a database of EEG signals from other individuals.

The method also involves controlling 610 the ear-worn device using the selected control movements processed by the selected data analysis pipeline or the multiple pipelines from which the weighted combination is computed. The processes shown in FIG. 6 can be implemented by an ear-worn electronic device or by the ear-worn electronic device communicatively coupled to a processor-based system, such as a smartphone, tablet, laptop or desktop computer. The processor-based system may cooperate with processors of the cloud to implement the processes shown in FIG. 6. In some embodiments, the ear-worn electronic device is communicatively coupled to the cloud (without use of the processor-based system) and cooperates with a processor(s) of the cloud to implement the processes shown in FIG. 6.

Figure 7:
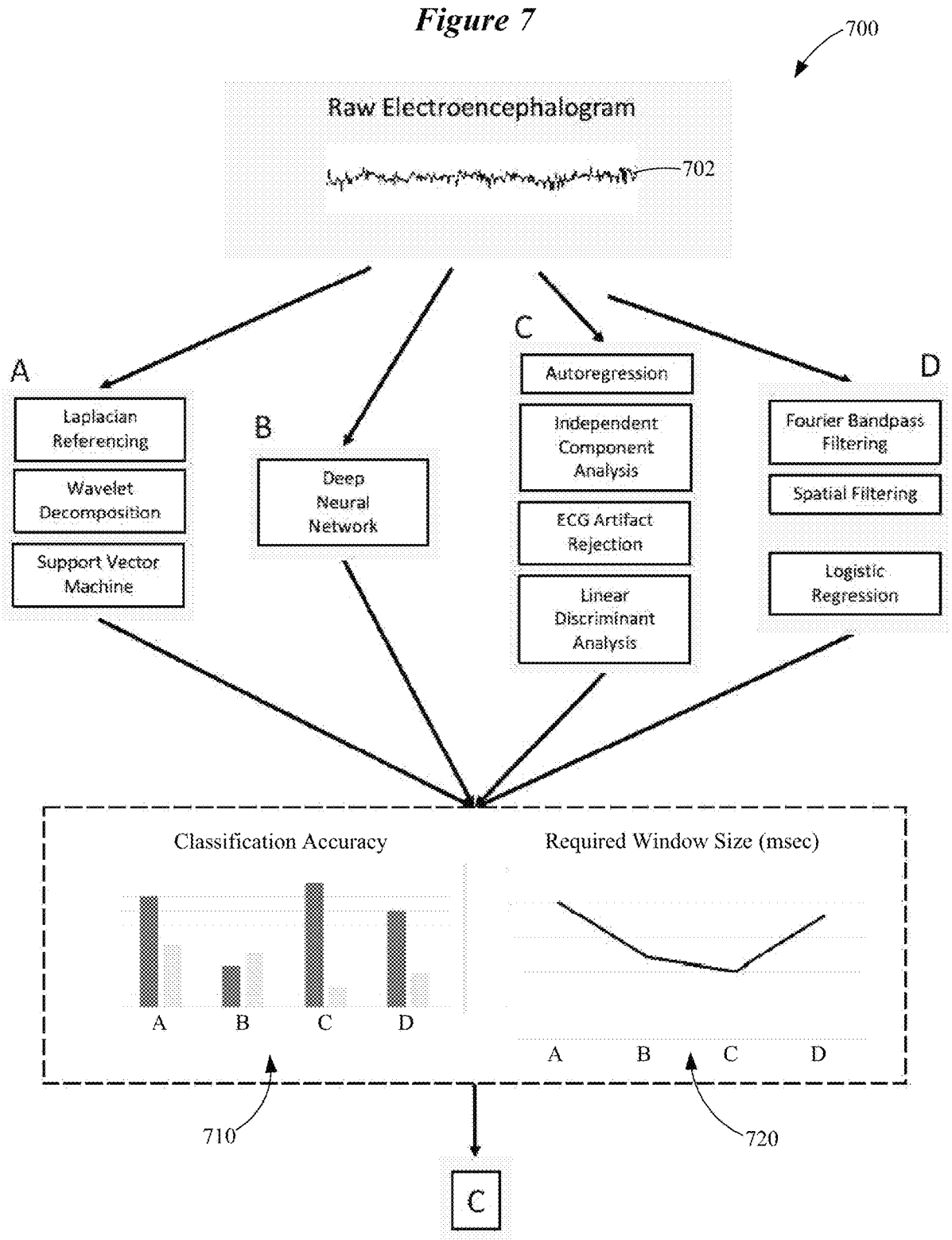
FIG. 7 illustrates a system configured to implement a learning phase in accordance with various embodiments.

FIG. 7 illustrates a system 700 configured to implement a learning phase in accordance with various embodiments. Recorded neural data, in this case an EEG signal 702 obtained at or near the wearer's ear, is submitted to a variety of candidate data analysis pipelines. In this illustrative example, four candidate pipelines, A-D, are shown. It is understood that fewer or more than four candidate data analysis pipelines can be used. Each of the candidate analysis pipelines A-D is individually optimized for a plurality of metrics related to accuracy and real-time speed of operation, herein termed performance metrics. The optimization of each of the candidate analysis pipelines A-D is similar to the approach to motor BCI development illustrated in FIG. 5.

In the illustrative example shown in FIG. 7, candidate data analysis pipeline A involves Laplacian re-referencing, spectral decomposition using wavelets, and classification using a support vector machine. Candidate data analysis pipeline B involves a deep neural network. Candidate data analysis pipeline C involves denoising using artifact rejection to remove cardiac (ECG) artifacts, spectral decomposition using autoregression, independent component analysis to reduce the dimensionality of the data, and then classification using linear discriminant analysis. Candidate data analysis pipeline D uses Fourier bandpass filtering and spatial filtering for denoising and dimensionality reduction, then classifies using logistic regression. Many other configurations of signal processing steps are conceivable as alternatives to these examples as would be readily understood by one of ordinary skill in the art. The performance of these optimized data analysis pipelines A-D is then ranked based on the same metrics. The best performing data analysis pipeline is implemented in the ear-worn electronic device to be used by the wearer.

Figure 8:
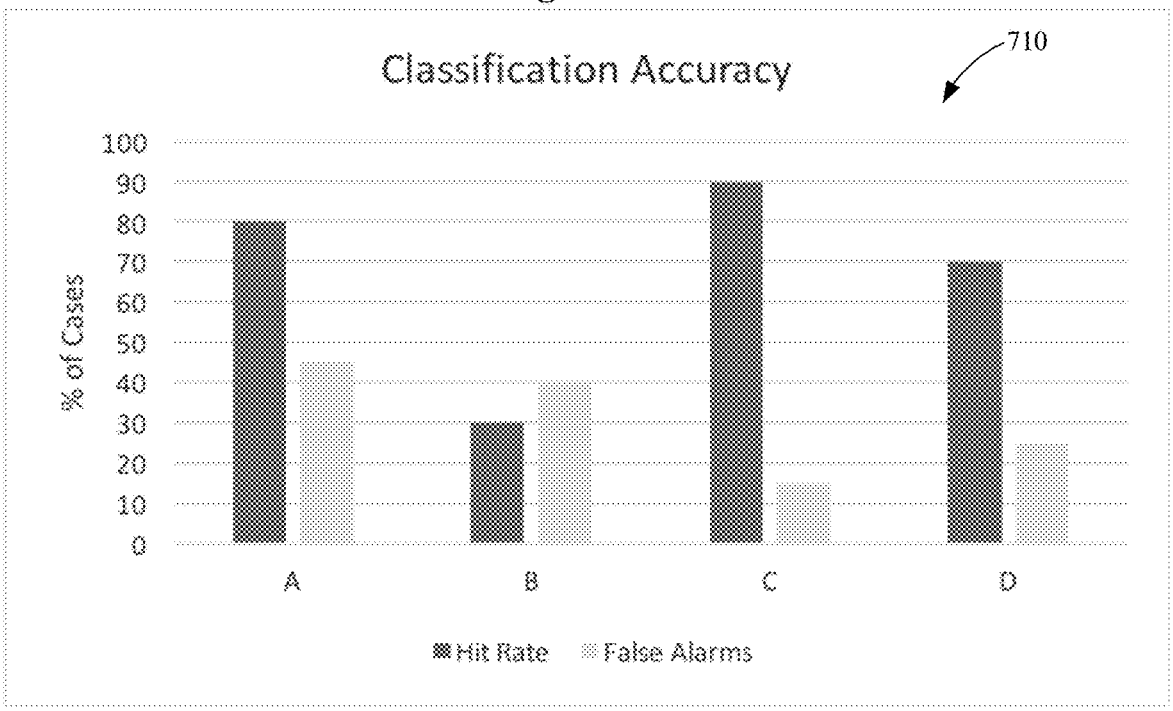
FIG. 8 is a graph of classification accuracy of a multiplicity of disparate data analysis pipelines in accordance with various embodiments.
Figure 9:
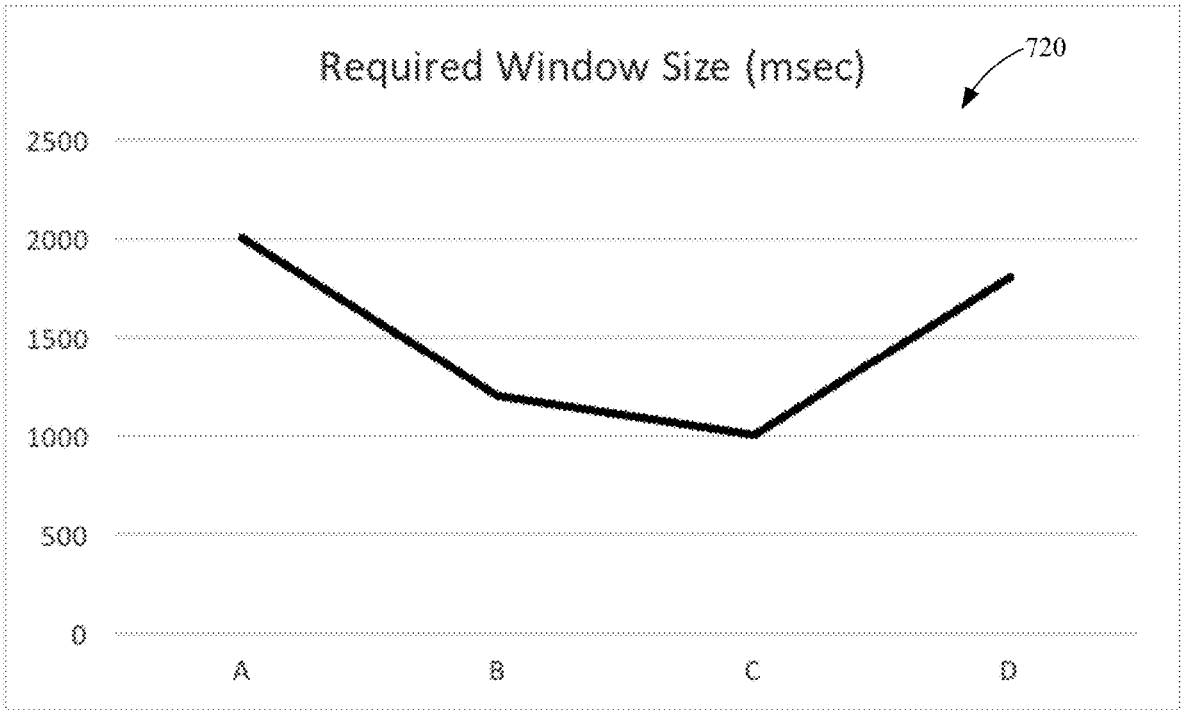
FIG. 9 is a graph of window size required for accurate classification by a multiplicity of disparate data analysis pipelines in accordance with various embodiments.

As is shown in FIGS. 7-9, the candidate data analysis pipelines A-D are compared on the basis of the classifier's hit rate, false alarm rate (see FIG. 8), and the size of the data window required for correct classification (see FIG. 9). Other metrics may be relevant to selecting an optimal data analysis pipeline, such as processing time and power consumption, according to the requirements and specifications of the hardware platform of the ear-worn electronic device that incorporates the real-time motor BCI. Based on the classifier's hit rate, false alarm rate, and the size of the required data window, the system 700 selects the candidate data analysis pipeline that will provide the best online (real-time) performance for the wearer, which in this case is data analysis pipeline C. As is shown in FIG. 8, candidate data analysis pipeline C has the highest hit rate (90%) and the lowest false alarm rate (15%). Candidate data analysis pipeline C also has the smallest required window size, and therefore may have the fastest real-time operation. In other embodiments, weighting of the available candidate data analysis pipelines to combine their outputs rather than selection of a single pipeline can be performed based on the relevant performance metrics.

Use of a multiplicity of candidate analysis pipelines allows the system 700 to characterize the neural signatures associated with the wearer's selected control movements, involving extraction of features in the temporal, spectral, and spatial domains. Use of a multiplicity of candidate analysis pipelines also allows the system 700 to determine the optimal feature translation algorithm, which may be an optimal method for discrete classification or an optimal continuous mapping of neural features to device control parameters (e.g., using a form of regression).

Examples of the candidate spatial features include source estimation, spatial filters (e.g., Laplacian derivations, Common Spatial Patterns), independent component analysis (ICA), pooling, re-referencing, or subtraction, as well as computing indices describing the relationships between sensors such as correlation, coherence, phase differences, and measurements of laterality. Examples of candidate spectro-temporal features include rate of zero crossings, Hilbert transforms, wavelet decomposition, Fourier-based spectral decomposition, Empirical Mode Decomposition, autoregression, matching pursuit, and a Welch periodgram.

The neural oscillations (sensorimotor rhythms) produced by the motor cortex have a characteristic non-sinusoidal shape which might provide a basis for better detection of these signals against a background of other neural activity. When decomposed using Fourier methods, this non-sinusoidal shape results in harmonics that can be identified using bicoherence. Alternatively, the non-sinusoidal shape of neural oscillations can be used to select a more appropriate basis function for spectral decomposition. These are included among the plurality of methods for spectro-temporal feature extraction that can be used by the methods and systems disclosed herein. Examples of discrete feature translation algorithms include classification via linear discriminant analysis, support vector machines, random forests, or logistic regression. Alternatively, a learning method that combines feature extraction and determination of the feature translation algorithm can be used, such as a deep neural network. The optimal data analysis pipeline, or an optimal combination of pipelines, can be selected based on a variety of performance metrics related to the accuracy of the motor BCI and real-time speed and efficiency of operation.

Other embodiments are directed to a process of re-learning that updates a data analysis pipeline to further optimize performance with the wearer's existing control movements, to add new control movements, to adapt to changes in the wearer's neural activity patterns or to identify context-dependent or chronological variations in these neural activity patterns (e.g., circadian variability, perhaps associated with fatigue).

Figure 10:
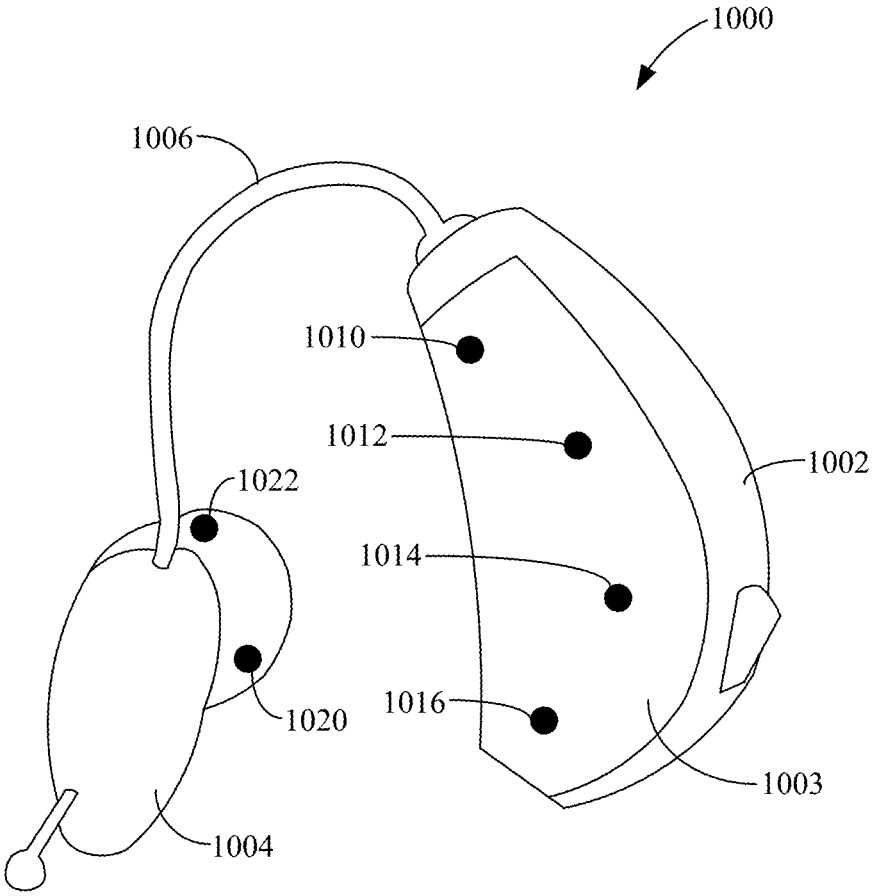
FIG. 10 shows an ear-worn electronic device which incorporates a motor brain-computer interface comprising a multiplicity of EEG sensors adapted to sense EEG signals at the wearer's ear and/or in the ear canal in accordance with various embodiments.

Additional details of extracting features in the temporal, spectral, and spatial domains by disparate data analysis pipelines are provided with reference to FIG. 10. FIG. 10 shows an ear-worn electronic device 1000 which incorporates a motor BCI in accordance with various embodiments. The ear-worn electronic device 1000 includes an on-the-ear or behind-the-ear component 1002 and a receiver 1004 adapted to fit near or in the ear canal of the wearer. The receiver 1004 is connected to the component 1002 via a tube 1006. The component 1002 typically includes signal processing electronics, a power source, a microphone (e.g., a microphone array), and a wireless transceiver (e.g., a Bluetooth® transceiver). A number of EEG sensors (e.g., electrodes) 1010, 1012, 1014 and 1016 are distributed on the outer surface of the component's housing 1003, and are configured to make contact with the wearer's scalp at or proximate to the wearer's ear. The receiver 1004 may also include one or more EEG sensors, such as sensors 1020 and 1022. The EEG sensors 1020 and 1022 situated on the outer surface of the receiver 1004 provide for the detection of EEG signals from within the wearer's ear.

The EEG signals associated with control movements by the wearer manifest differently at the different EEG sensors on the housing 1003 and the receiver 1004. The voltage measured at an EEG sensor is a linear combination of signals from a multitude of neural generators. These signals are smeared due to volume conduction through the scalp, skull and other layers of tissue surrounding the brain. Thus, the EEG signals obtained at different EEG sensors of the ear-worn electronic device are often highly correlated, yielding little unique information at each site. However, a motor BCI can be configured to use spatial filters to alleviate this problem. So-called 'reference free' strategies achieve this aim by subtracting from each EEG channel different types of weighted averages across EEG channels to reduce the redundant information. For example, the 'common average reference' averages all EEG channels together and subtracts this average from all channels. This effectively makes the signals measured by each EEG sensor more focal by reducing components which are common across all electrodes. This approach also helps deal with external electromagnetic interference.

Blind Source Separation (BSS) methods construct optimal spatial filters solely based on the statistics of the EEG data. They are called blind because they are completely data driven approaches. With respect to applications for motor BCI, the Independent Component Analysis (ICA) family of algorithms are the most commonly used type of BSS methods. ICA algorithms aim to create several linear combinations of the source data which are maximally statistically independent from one another. Here, statistical independence means that the distributions of the derived linear combinations share no mutual information. In other words, the joint probability distribution of two derived linear combinations would be equal to the product of the marginal distributions of those linear combinations. ICA decomposes an EEG signal into functionally distinct neural sources so long as the activations from those sources vary in the temporal domain. For motor BCI applications, this is very attractive because it means that, so long as the control signals are associated with temporally independent sources, ICA should automatically derive spatial filters that differentiate the control movement signals. An ICA approach works well even with noisy, artifact-ridden data. So long as these noise sources are statistically independent from the neural signals of interest, they will tend to separate out into their own ICA components.

The Common Spatial Pattern (CSP) algorithm is a widely used algorithm for creating spatial filters for motor BCIs. CSP generates spatial filters from a labeled training set of data to distinguishing between a pair of movement classes (e.g., right versus left hand movement). To extend CSP to more than two classes, CSPs are usually derived from multiple 'one vs. the rest' two class scenarios. CSP may have the best ability to isolate motor BCI-relevant sources, with the ICA family taking a close second place. However, the common variants of CSP handle noise less gracefully than ICA. They also require a much more carefully labeled and preprocessed training data to function optimally.

CSP generates a set of orthonormal spatial filters. The maximum number of filters generated is equal to the number of channels of EEG data provided to the algorithm. Unlike ICA, CSP is not a source separation method. CSP finds filters that are optimized for the two classes of data in the training set. After applying the filter, the variance of one class will be maximized and the other will be minimized.

The filters generated by CSP are ordered such that the first CSP filter maximally emphasizes the first class and de-emphasizes the second class, while the final CSP filter maximally emphasizes the second class and de-emphasizes the first. The output of these two filters is often selected as features for classification. It is important to note that artifacts such as blinks or muscle motion may lead to misleading non-generalizable filters. Variants on the CSP algorithm can be more robust to the effects of noise in the training data. CSP is commonly carried out using a wideband filtered EEG signal, often in the 8-30 Hz range to cover alpha and beta ERD/ERS, but can be carried out in a frequency-specific fashion, such as in the known ERDmax method. This method specifies the frequency bands and times at which ERD/ERS are expected to derive CSP filters that maximize these power fluctuations.

Pooling is another example of a candidate spatial feature, and involves grouping the EEG sensors and adding or averaging their signals together. Subtraction is a candidate spatial feature that involves subtracting EEG signals from one EEG sensor out from other EEG sensors. This helps to isolate different EEG signals and their sources within the brain. Re-referencing is a variation of subtraction.

Other candidate spatial features include those that describe relationships between a plurality of EEG sensors, wherein the relationships include one or more of correlations, coherence, and laterality. Correlation is a measure of how similar an EEG signal is when measured at different EEG sensors. Voltages of the EEG sensors can be compared, and a correlation can be calculated. Coherence is similar to correlation, but takes into account where the EEG signal is in its sinusoidal shape. Coherence involves performing spectral analysis on the EEG signal first, followed by a correlation on the spectral analysis to obtain coherence, which provides information about phase differences. Laterality can be measured by comparing EEG sensor signals from one side of the head (via a first ear-worn electronic device) with those acquired from the other side of the head (via a second ear-worn electronic device). For example, when comparing an imagined left-hand control movement to an imagined right-hand control movement, the right-hand movement should be more measurable on the left side of the brain and vice a versa. A fundamental challenge with obtaining spatial features in an ear-level device arises from the fact that devices on the two sides of the head can be collecting EEG data independently. Synchronized transmission of EEG data between the two ear-worn electronic devices, or from both devices to a common processor (for example, on a smartphone or in the cloud) is therefore necessary to derive spatial features that incorporate signals from both sides of the head.

Examples of candidate spectro-temporal features include rate of zero crossings, Hilbert transforms, wavelet decomposition, Fourier-based spectral decomposition, Empirical Mode Decomposition, autoregression, matching pursuit, and a Welch periodgram. Fourier-based spectral decomposition involves taking the Fourier transform (e.g., Fast Fourier Transform or FFT) of the EEG signal by comparing the EEG signal to many different sinusoids with different rates of transition (corresponding to different frequencies). These sinusoids are called basis functions. The process of comparing the signal of interest, in this case EEG, to a set of basis functions, which may or may not be sinusoidal, and represent different rates of oscillation, is the fundamental operation of many forms of spectral decomposition. This is well understood by those of ordinary skill in the art.

As was discussed previously, the neural oscillations (sensorimotor rhythms) produced by the motor cortex have a characteristic non-sinusoidal shape which might provide a basis for better detection of these signals against a background of other neural activity. Wavelet decomposition can operate effectively on non-sinusoidal EEG signals. Wavelet decomposition takes a template wave shape (commonly referred to as a mother wavelet), and stretches or shrinks this template wave shape (referred to as scaling) to detect oscillatory activity in different frequency bands. The stretching or shrinking of this wavelet has consequences in both the spectral and the temporal domain, resulting in a similar tradeoff between frequency resolution and temporal resolution as exists with Fourier decomposition.

In wavelet decomposition, the tradeoff between these two dimensions can be biased towards one dimension or the other by specifying a time constant, which prioritizes temporal resolution at low values and frequency resolution at high values. For motor EEG analysis, a time constant of 7 is commonly used. Wavelets contain energy in a narrow band around their center frequency and are shifted in time (referred to as translation) to decompose the spectrum along the temporal dimension. Wavelets are best applied to neuroelectric data if the shape of the mother wavelet resembles the shape of the neural response that is being measured. Mother wavelets can be selected a priori based on expert knowledge of the brainwaves of interest, for example the non-sinusoidal waveshape of mu rhythms, or many mother wavelets can be used and the coefficients generated by the spectral decomposition can be examined for goodness of fit. Examples of useful wavelets for EEG analysis include Mexican hat, Morlet, and matched Meyer wavelets.

A well-understood aspect of motor EEG is that the most reactive spectral bands differ between individuals. To address these individual differences, ERD/ERS can be computed in a range of narrow bands, and the subset of frequencies that display the greatest power changes as a function of the movement condition can be selected. In wavelet-based analyses, instead, the most reactive bands can be selected by looking for peaks in the time-frequency spectrum. In addition to isolating the most reactive bands, it can also be important to evaluate the correlations between bands through measures like bicoherence. For example, many individuals manifest mu rhythms both in the alpha range and as a harmonic in the beta range. This harmonic can be dissociated from true beta modulation by exposing its correlation with alpha-band reactivity.

Like wavelet decomposition, Hilbert transforms are not limited to sinusoids as the basis functions and may characterize EEG signals more accurately. Fourier decomposition, and its inherent problems with nonstationary signals, can be avoided entirely by combining Empirical Mode Decomposition (EMD) with the Hilbert transform. In EMD, time-domain approximations of the observed oscillation called Intrinsic Mode Functions (IMFs) are fit iteratively to the signal, such that the residual after each approximation forms the basis for the next IMF. Application of the Hilbert transform to each of these IMFs yields a time-frequency spectrum known as the Hilbert-Huang amplitude spectrum (HHS). It has been demonstrated that HHS clearly extracts movement-related power fluctuations and that this approach can be used to target alpha power by selecting IMFs in this frequency range. A typical problem with HHS frequency analysis when applied to multichannel EEG is that the number, and frequency content, of extracted IMFs might not match between channels, making between-channel comparisons challenging or impossible. Multivariate extensions on EMD can solve this problem and can be implemented successfully in motor BCI applications.

Another method that permits wideband frequency analysis by iteratively removing template waveforms (e.g., Gabor functions) from the signal is based on matching pursuit. A simpler method of time-frequency decomposition involves using the Welch periodgram to extract the power spectral density, which yields similar success to autoregressive and wavelet-based methods.

Autoregressive modeling is an alternative to Fourier-based spectral decomposition due to its smoother power spectrum, which can be easier to interpret. Autoregressive spectral decomposition involves two steps of analysis. First, a product is calculated between the signal and a time-shifted copy of itself. These copies are shifted by one sample, and the limit of this time shifting is specified by a model parameter which requires optimization. The autoregressive model assumes that each point in the time series can be predicted based on a weighted combination of previous values in the series, plus an error term. Like Fourier decomposition, autoregressive modeling rests on an assumption of stationarity, which is not held by EEG data. In order to analyze EEG data, the EEG signal must be segmented into windows within which the signal is generally stationary. The lengths of these windows can be selected by visual inspection of the data, by using objective metrics such as statistical tests of stationarity, or by fitting the autoregressive model and examining the values that are yielded for signs of departure from stationarity.

An advantage of autoregressive spectral decomposition for real-time motor BCI applications is that the length of the window does not constrain spectral resolution. Spectral resolution in an autoregressive model is, however, affected by the sampling rate of the data, and decreases as sampling rate increases, unless model order is increased to offset this effect. For example, a twofold increase in sampling rate requires roughly a twofold increase in model order. Increased model orders result in longer computation times. For a motor BCI that analyzes EEG signals, optimal model order selection can be achieved based primarily on the desired spectral resolution of the analysis, and should correspond to the period of the lowest frequency of interest. In addition to power, autoregressive spectral decomposition tracks peak frequency and bandwidth. These parameters can yield useful adjunct information to the power spectrum, because motor activation can be associated with a decrease in peak frequency and an increase in the bandwidth of alpha.

Over time, a wearer's experience of interacting with the motor BCI of an ear-worn electronic device can change distinctly. Embodiments are directed to a process of re-learning that updates a data analysis pipeline of the motor BCI to adapt to changes in the wearer's neural activity patterns or to identify context-dependent or chronological variations in these neural activity patterns and further optimize performance with the wearer's existing control movements. In addition, re-learning may be performed to add new control movements. In the same vein as the learning stage of a motor BCI, re-learning requires EEG data that is labeled with the control movements that the user is performing. For example, EEG data that is associated with an imagined right fist closure is labeled as such. The classic method of obtaining these labeled data in the art is to explicitly guide the user to produce these control movements while monitoring the EEG. The present disclosure incorporates this standard method of re-learning, which might be made more engaging by incorporation into a game. However, an alternative, "transparent" re-learning process is also made possible based on historical EEG data from online operation of the motor BCI. In this case, because the wearer is not prompted to perform certain movements, the wearer's true intent must be inferred from patterns of interaction with the motor BCI that are suggestive of erroneous motor BCI operation. For example, a series of interactions involving frequent reversals (e.g., right imagined fist, left imagined foot, right imagined fist, left imagined foot) might suggest that the system is misclassifying user control movements. Alternatively, during continuous device interaction, a trajectory analysis that reveals a sub-optimal path to the wearer's target endpoint might reveal an inappropriate mapping of neural signals to the dimensions of device control. In addition, re-learning might take place to enhance the operation of the motor BCI by incorporating information regarding the wearer's state, environment, or time of day during previous motor BCI usage to achieve better classification in different contexts or chronological periods. These computations can be carried out entirely on the ear-worn electronic device or in combination with a mobile device and/or cloud based computational framework.

According to some embodiments, a re-learning process involves repeating processing of the EEG signals and selection of one of a plurality of disparate data analysis pipelines or a weighted combination of the data analysis pipelines based on a schedule, in response to errors, in response to a wearer command, or to add a new control movement. In another re-learning embodiment, selecting one of the plurality of disparate data analysis pipelines, or a weighted combination of data analysis pipelines, is carried out based on new data collected in response to wearer prompts generated by the ear-worn electronic device, alone or in cooperation with an external device (e.g., a smartphone). According to other embodiments, a re-learning process can involve selecting one of a plurality of disparate data analysis pipelines, or a weighted combination of data analysis pipelines, based on stored EEG signals from the wearer's interaction with the ear-worn electronic device combined with indices that are indicative of whether an error occurred in the translation of wearer intent by the ear-worn electronic device.

Successful implementation of a motor BCI of an ear-worn electronic device involves a number of processes, which can be broadly categorized as algorithm training, user training, and adaptation. To operate in the real world, the motor BCI typically utilizes classifiers to identify motor commands in real-time. Different algorithms are required for different types of user commands (e.g., commands that are issued in response to a prompt versus commands that are generated spontaneously). Regardless of type, to achieve optimal performance, these algorithms are trained using each individual's brain data—this is because each person's brain activations are unique. In training and optimizing the classifier, some important factors that determine the usability of the interface, such as the false alarm rate (when the system mistakenly identifies a command that was not presented), the false rejection rate (when the system mistakenly fails to identify a command that was presented) and the detection time for motor commands (how long it takes the system to identify a command that is being provided), can be considered.

Wearer training employs these real-time classifiers or distance metrics to provide the wearer with feedback to help them improve their control over the motor BCI of the ear-worn electronic device. For example, an animated hand might move on a screen to mimic an imagined motor command. This process works best with "elaborated" feedback which gives the wearer specific instructions for improving performance. User training for a motor BCI is also more efficient with positive social feedback. In the absence of other humans to provide such interaction, an electronic, virtual assistant can be provided which encourages the wearer through positive feedback. Yet another method which appears to improve user performance is to overestimate the wearer's performance, leading the wearer to believe that his or her performance is better than it truly is. Any or all of these techniques can be incorporated in various embodiments of the present disclosure. User training causes changes to the user's neural signals, making them easier for real-time classifiers to identify. A natural consequence of these changes, as well as other changes over time, is that the classification algorithm must be re-trained (adapted) to perform optimally with the wearer's new neural responses. This process can be repeated periodically to maintain optimal performance.

Figure 11:
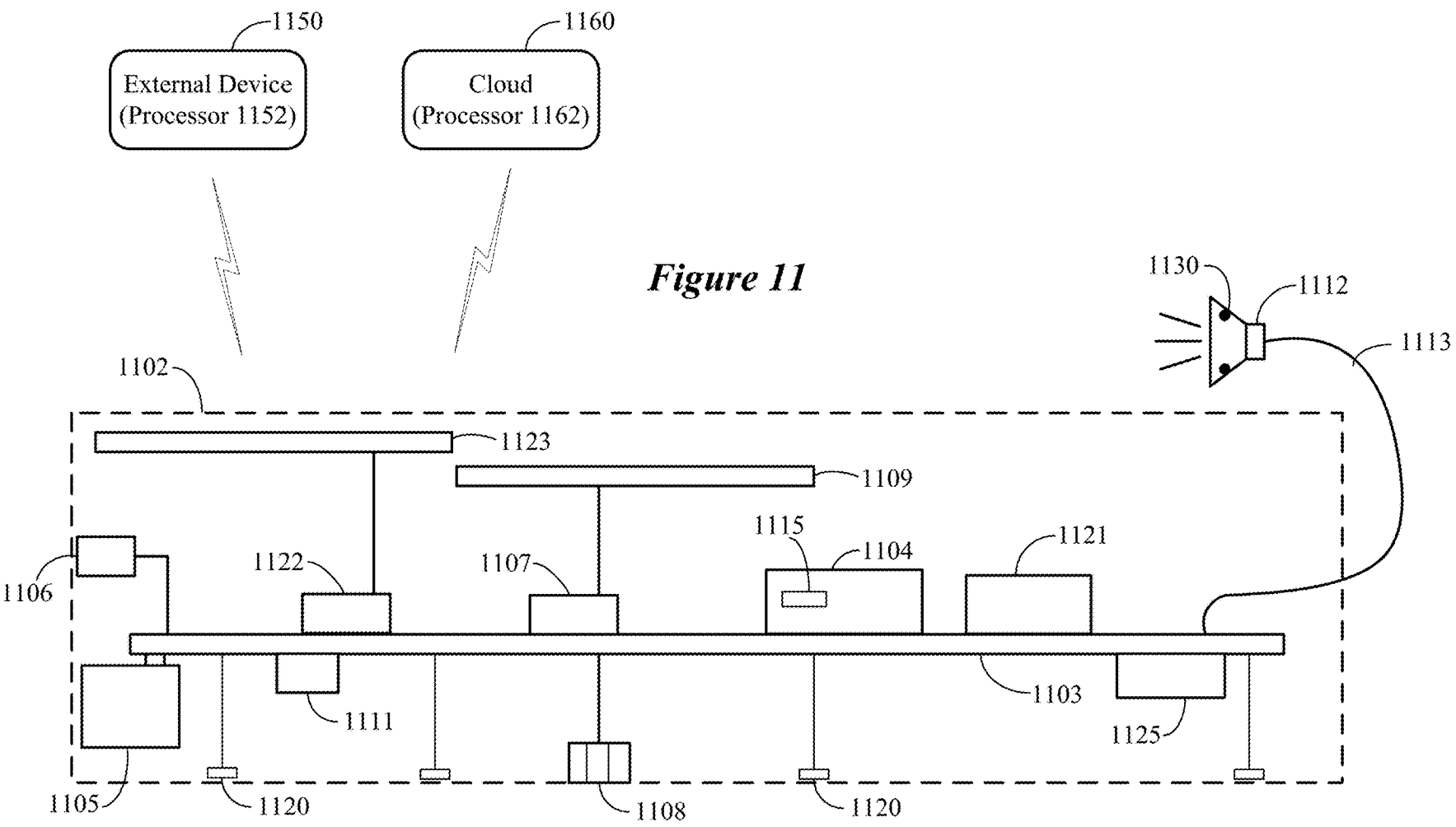
FIG. 11 is a block diagram showing various components that can be incorporated in an ear-worn electronic device comprising a motor brain-computer interface in accordance with various embodiments.

FIG. 11 is a block diagram showing various components that can be incorporated in an ear-worn electronic device in accordance with various embodiments. The block diagram of FIG. 11 represents a generic ear-worn electronic device that incorporates a motor BCI for purposes of illustration. Some of the components shown in FIG. 11 can be excluded and additional components can be included depending on the design of the ear-worn electronic device.

The ear-worn electronic device 1102 includes several components electrically connected to a mother flexible circuit 1103. A battery 1105 is electrically connected to the mother flexible circuit 1103 and provides power to the various components of the ear-worn electronic device 1102. Power management circuitry 1111 is coupled to the mother flexible circuit 1103. One or more microphones 1106 (e.g., a microphone array) are electrically connected to the mother flexible circuit 1103, which provides electrical communication between the microphones 1106 and a digital signal processor (DSP) 1104. Among other components, the DSP 1104 incorporates, or is coupled to, audio signal processing circuitry. The DSP 1104 has an audio output stage coupled to a receiver 1112. The receiver 1112 (e.g., a speaker) transforms the electrical signal into an acoustic signal. A physiological data acquisition unit 1121 (comprising electronics for physiological data measurement, such as amplifiers and analog-digital conversion) is coupled to one or more physiologic sensors 1120 and to the DSP 1104 via the mother flexible circuit 1103. One or more user switches 1108 (e.g., on/off, volume, mic directional settings) are electrically coupled to the DSP 1104 via the flexible mother circuit 1103.

The motor BCI of the ear-worn electronic device 1102 includes a number of EEG sensors 1120 distributed on the housing of the device 1102. The EEG sensors 1120 are coupled to an optimized data analysis pipeline 1115 implemented by the DSP 1104 or other processor of the ear-worn electronic device 1102. The EEG sensors 1120 can be coupled to the data analysis pipeline 115 via the mother flexible circuit 1103 or directly. One or more EEG sensors 1130 can be mounted on the receiver 1112, and can be coupled to the data analysis pipeline 1115 via electrical conductors extending along on a tube 1113. The electrical conductors couple to the data analysis pipeline 1115 via the mother flexible circuit 1103 or directly.

The ear-worn electronic device 1102 may incorporate a communication device 1107 coupled to the flexible mother circuit 1103 and to an antenna 1109 via the flexible mother circuit 1103. The communication device 1107 can be a Bluetooth® transceiver, such as a BLE (Bluetooth® low energy) transceiver or other transceiver (e.g., an IEEE 802.11 compliant device). The communication device 1107 can be configured to communicate with one or more external devices 1150 (which includes one or more processor, e.g., processor 1152), such as a smartphone, tablet, laptop, TV, or streaming device. In some embodiments, an optional communication device 1122 provides direct interaction with cloud computing and storage resources 1160 (which includes one or more processor, e.g., processor 1162) via telecommunications protocols (e.g., 5G or WiFi). The optional communication device 1122 can be coupled to an optional antenna 1123 or to antenna 1109 in some configurations.

As was discussed previously, some or all of the processes described hereinabove can be implemented by the DSP 1104, alone or in combination with other electronics. For example, analog and digital circuitry (which can include DSP 1104) can be configured to support one or more data analysis pipelines. The ear-worn electronic device 1102 can include dedicated analog and/or digital circuitry configured to support analyses in the time-frequency and spatial domains. In some embodiments, the DSP 1104 or other circuitry can be configured to transmit data to an external device (e.g., a smartphone 1150 or the cloud 1160) for further processing in the time-frequency and spatial domains. According to some embodiments, communication device 1107 can be configured to facilitate communication with another ear-worn electronic device 1102 worn by the wearer (e.g., facilitating ear-to-ear communication between left and right devices 1102). Features related to the EEG signals acquired at each ear can be communicated between the two ear-worn electronic devices 1102. EEG signal features acquired at each ear can be compared and various data can be generated based on the comparison (e.g., differences in alpha band power).

Various embodiments are directed to a system comprising the ear-worn electronic device 1102 configured to sense EEG signals from or proximate an ear of the wearer using a plurality of EEG sensors 1120. The processor 1104 is configured to detect, during a baseline period of no wearer movement, EEG signals from the EEG sensors 1120. The processor 1104 is also configured to detect, during each of a plurality of candidate control movements by the wearer, EEG signals from the EEG sensors 1120. At least one of the processors 1104, 1152, and 1162 is configured to compute, using the EEG signals, discriminability metrics for the candidate control movements and the baseline period. The discriminability metrics indicate how discriminable neural signals associated with the candidate control movements and the baseline period are from one another. At least one of the processors 1104, 1152, and 1162 is also configured to select a subset of the candidate control movements using the discriminability metrics, wherein each of the selected control movements defines a neural command for controlling the ear-worn electronic device 1102 by the wearer. In some embodiments, the processor 1104 of the ear-worn electronic device 1102 is configured to detect the EEG signals from the EEG sensor 1120, and one (or both) of the processors 1152 (of the external device 1150) and 1162 (of the cloud 1160) is/are configured to compute the discriminability metrics and select the subset of candidate control movements.

According to some embodiments, the EEG signals associated with each of the selected control movements are obtained in response to instructions and feedback delivered to the wearer via the external device 1150 or the cloud 1160 communicatively coupled to the ear-worn electronic device 1102. For example, the ear-worn electronic device 1102 can deliver audio information to the wearer and receive wearer selections (e.g., control movement preferences) or other inputs via the external device 1150. In other embodiments, the EEG signals associated with each of the selected control movements are obtained in response to instructions and feedback delivered to the wearer by audio input and output electronics 1106, 1112 of the ear-worn electronic device 1102. In such embodiments, the ear-worn electronic device 1102 can include a speech recognition device 1125 to facilitate communication of instructions and feedback between the wearer and the ear-worn electronic device 1102.

At least one of the processors 1104, 1152, and 1162 is configured to process the EEG signals associated with each of the selected control movements and the baseline period using a plurality of disparate data analysis pipelines. Each of the data analysis pipelines is configured to translate features of the EEG signals to device control parameters for controlling the ear-worn electronic device 1102 in response to the selected control movements. At least one of the processors 1104, 1152, and 1162 is configured to select one of the plurality of disparate data analysis pipelines or a weighted combination of the data analysis pipelines that most effectively translates features of the EEG signals to device control parameters. In some embodiments, performance metrics for the data analysis pipelines are generated by the processor 1104 of the ear-worn electronic device 1102. In other embodiments, performance metrics for the data analysis pipelines are generated by the processor 1152 of the external device 1150 or the processor 1162 of the cloud 1160.

This document discloses numerous embodiments, including but not limited to the following:

Item 1 is a method implemented using an ear-worn electronic device configured to be worn by a wearer, the method comprising:

detecting, during a baseline period of no wearer movement, EEG signals from or proximate an ear of the wearer using the ear-worn electronic device;

detecting, during each of a plurality of candidate control movements by the wearer, EEG signals from or proximate the ear of the wearer using the ear-worn electronic device;

computing, using a processor operating on the EEG signals, discriminability metrics for the candidate control movements and the baseline period, the discriminability metrics indicating how discriminable neural signals associated with the candidate control movements and the baseline period are from one another; and selecting a subset of the candidate control movements using the discriminability metrics, each of the selected control movements defining a neural command for controlling the ear-worn electronic device by the wearer.

Item 2 is the method of item 1, wherein the discriminability metrics comprise distance metrics.

Item 3 is the method of item 2, wherein the distance metrics are computed based on a mapping of spectro-temporal or spatial features of the EEG signals onto a topological space.

Item 4 is the method of item 2, wherein the distance metrics are computed based on a mapping of relationships between different features extracted from the EEG signals or between different EEG signals onto a topological space.

Item 5 is the method of item 1, wherein the discriminability metrics comprise a weighted combination of distance metrics and classifier outputs.

Item 6 is the method of claim 5, wherein the classifier outputs, including specificity and sensitivity, are differently weighted according to functions of the ear-worn electronic device to be controlled.

Item 7 is the method of item 1, comprising combining the discriminability metrics with wearer preferences to select the subset of candidate control movements to be used for future interaction between the wearer and the ear-worn electronic device.

Item 8 is the method of item 1, further comprising:

processing the EEG signals associated with each of the selected control movements and the baseline period using a plurality of disparate data analysis pipelines implemented by the processor, each of the data analysis pipelines configured to translate features of the EEG signals to device control parameters for controlling the ear-worn electronic device in response to the selected control movements;

selecting one of the plurality of data analysis pipelines or a weighted combination of the data analysis pipelines that most effectively translates features of the EEG signals to device control parameters; and controlling the ear-worn electronic device using the selected control movements processed by the selected data analysis pipeline or the weighted combination of data analysis pipelines.

Item 9 is the method of item 8, wherein the features of the EEG signals translated to device control parameters comprise one or more of temporal, spectral, and spatial features of the EEG signals.

Item 10 is the method of item 8, wherein:

at least one of the data analysis pipelines or the weighted combination of the data analysis pipelines is configured to translate features of the EEG signals to device control parameters in a discrete mode; and at least one of the data analysis pipelines or the weighted combination of the data analysis pipelines is configured to translate features of the EEG signals to device control parameters in a continuous mode.

Item 11 is the method of item 8, wherein selecting one of the plurality of data analysis pipelines or the weighted combination of data analysis pipelines is based on performance metrics that are yielded using a combination of the wearer's EEG signals and a database of EEG signals from other individuals.

Item 12 is the method of item 8, wherein processing of the EEG signals and selecting one of the plurality of data analysis pipelines or the weighted combination of the data analysis pipelines is repeated based on a schedule, in response to errors, in response to a wearer command, or to add a new control movement.

Item 13 is the method of item 12, wherein selecting one of the plurality of data analysis pipelines or the weighted combination of data analysis pipelines is implemented based on stored EEG signals from the wearer's interaction with the ear-worn electronic device combined with indices that are indicative of whether an error occurred in translation of wearer intent by the ear-worn electronic device.

Item 14 is a system, comprising:

an ear-worn electronic device configured to be worn by a wearer, the ear-worn electronic device comprising a plurality of EEG sensors configured to sense EEG signals from or proximate an ear of the wearer; and at least one processor configured to:

detect, during a baseline period of no wearer movement, EEG signals from the EEG sensors;

detect, during each of a plurality of candidate control movements by the wearer, EEG signals from the EEG sensors;

compute, using the EEG signals, discriminability metrics for the candidate control movements and the baseline period, the discriminability metrics indicating how discriminable neural signals associated with the candidate control movements and the baseline period are from one another; and select a subset of the candidate control movements using the discriminability metrics, each of the selected control movements defining a neural command for controlling the ear-worn electronic device by the wearer.

Item 15 is the system of item 14, wherein the at least one processor comprises:

a first processor of the ear-worn electronic device configured to detect the EEG signals; and a second processor of an external device or the cloud configured to compute the discriminability metrics and select the subset of the candidate control movements.

Item 16 is the system of item 14, wherein the discriminability metrics comprise distance metrics.

Item 17 is the system of item 14, wherein the discriminability metrics comprise a weighted combination of distance metrics and classifier outputs.

Item 18 is the system of item 14 wherein the EEG signals associated with each of the selected control movements are obtained in response to:

instructions and feedback delivered to the wearer via an external device or the cloud communicatively coupled to the ear-worn electronic device; or instructions and feedback delivered to the wearer by audio input and output electronics of the ear-worn electronic device.

Item 19 is the system of item 14, wherein the ear-worn electronic device is configured to communicate with an external device that stimulates the wearer's body to augment or replace imaginary candidate control movements.

Item 20 is the system of item 14, wherein the at least one processor is further configured to:

process the EEG signals associated with each of the selected control movements and the baseline period using a plurality of disparate data analysis pipelines implemented by the processor, each of the data analysis pipelines configured to translate features of the EEG signals to device control parameters for controlling the ear-worn electronic device in response to the selected control movements; and select one of the plurality of disparate data analysis pipelines or a weighted combination of the data analysis pipelines that most effectively translates features of the EEG signals to device control parameters.

Item 21 is the system of item 20, wherein performance metrics for the data analysis pipelines are generated by the ear-worn electronic device.

Item 22 is the system of item 20, wherein performance metrics for the data analysis pipelines are generated by an external device or the cloud communicatively coupled to the ear-worn electronic device.

Item 23 is the system of item 20, wherein the ear-worn electronic device comprises circuitry configured to support the selected data analysis pipeline or the weighted combination of data analysis pipelines.

Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. A method implemented using an ear-worn electronic device configured to be worn by a wearer, the method comprising:

sensing, using a plurality of EEG sensors of a motor brain-computer interface (motor BCI) of the device, EEG signals elicited from the wearer in response to one or any combination of planned, imagined, and executed body movements of the wearer, wherein each of the one or any combination of planned, imagined, and executed body movements is pre-selected for the wearer and corresponds to a neural command for controlling the device by the wearer;

receiving the EEG signals by a processor of the motor BCI;

translating, by the processor, features of the EEG signals to device control parameters for controlling the ear-worn electronic device; and controlling the device using the device control parameters.

2. The method of claim 1, wherein each of the one or any combination of planned, imagined, and executed body movements is pre-selected for the wearer to elicit EEG signals in excess of a threshold established for the wearer.

3. The method of claim 2, wherein the threshold represents a measure of discernibility between at least two of the planned, imagined, and executed body movements of the wearer.

4. The method of claim 2, wherein the threshold represents a measure of discernibility between at least any two of the planned, imagined, and executed body movements of the wearer and from non-movement of the wearer.

5. The method of claim 2, wherein the threshold distinguishes between acceptable and unacceptable distance metric values of at least two of the planned, imagined, and executed body movements of the wearer.

6. The method of claim 1, comprising:

detecting, by the processor, at least alpha and beta power fluctuations in the EEG signals; and translating, by the processor, the power fluctuations to the device control parameters.

7. The method of claim 1, wherein the features of the EEG signals translated to device control parameters comprise one or more of temporal, spectral, and spatial features of the EEG signals.

8. The method of claim 1, wherein the processor comprises a data analysis pipeline configured to achieve one or both of a specified level of accuracy and real-time speed of operation.

9. The method of claim 8, comprising updating the data analysis pipeline to adapt to changes in the wearer's neural activity patterns or to identify context-dependent or chronological variations in the wearer's neural activity patterns.

10. The method of claim 1, wherein the EEG signals are received by the processor in response to:

instructions and feedback delivered to the wearer via an external device or the cloud communicatively coupled to the ear-worn electronic device; or instructions and feedback delivered to the wearer by audio input and output electronics of the ear-worn electronic device.

11. The method of claim 1, wherein controlling the ear-worn electronic device comprises one or more of:

selecting between omnidirectional and directional microphone modes;

controlling a beamforming feature of the device;

changing memory settings of the device; and controlling streaming from a streaming source to the device.

12. An ear-worn electronic device configured to be worn by a wearer, the device comprising:

a housing configured to be worn in, at or about an ear of the wearer; and a motor brain-computer interface (motor BCI) disposed at least in part in or on the housing, the motor BCI comprising:

a plurality of EEG sensors configured to sense EEG signals elicited from the wearer in response to one or any combination of planned, imagined, and executed body movements of the wearer, wherein each of the one or any combination of planned, imagined, and executed body movements is pre-selected for the wearer and corresponds to a neural command for controlling the device by the wearer; and a processor operatively coupled to the plurality of EEG sensors, the processor configured to:

receive the EEG signals from the plurality of EEG sensors;

translate features of the EEG signals to device control parameters for controlling the ear-worn electronic device; and control the device using the device control parameters.

13. The device of claim 12, wherein each of the one or any combination of planned, imagined, and executed body movements is pre-selected for the wearer to elicit EEG signals in excess of a threshold established for the wearer.

14. The device of claim 13, wherein the threshold represents a measure of discernibility between at least two of the planned, imagined, and executed body movements of the wearer.

15. The device of claim 13, wherein the threshold represents a measure of discernibility between at least any two of the planned, imagined, and executed body movements of the wearer and from non-movement of the wearer.

16. The device of claim 13, wherein the threshold distinguishes between acceptable and unacceptable distance metric values of at least two of the planned, imagined, and executed body movements of the wearer.

17. The device of claim 12, wherein the processor is configured to:

detect at least alpha and beta power fluctuations in the EEG signals; and translate the power fluctuations to the device control parameters.

18. The device of claim 12, wherein the features of the EEG signals translated by the processor to device control parameters comprise one or more of temporal, spectral, and spatial features of the EEG signals.

19. The device of claim 12, wherein the processor comprises a data analysis pipeline configured to achieve one or both of a specified level of accuracy and real-time speed of operation.

20. The device of claim 19, wherein the processor is configured to update the data analysis pipeline to adapt to changes in the wearer's neural activity patterns or to identify context-dependent or chronological variations in the wearer's neural activity patterns.

21. The device of claim 12, wherein the EEG signals are received by the processor in response to:

instructions and feedback delivered to the wearer via an external device or the cloud communicatively coupled to the ear-worn electronic device; or instructions and feedback delivered to the wearer by audio input and output electronics of the ear-worn electronic device.

22. The device of claim 12, wherein, the processor is configured to use the device control parameters to one or more of:

select between omnidirectional and directional microphone modes;

control a beamforming feature of the device;

change memory settings of the device; and control streaming from a streaming source to the device.

23. The device of claim 12, wherein the processor is disposed in the housing.

24. The device of claim 12, wherein the processor comprises a local processor disposed in the housing and a processor of an electronic device external of the ear-worn electronic device.

25. The device of claim 12, wherein the processor comprises a local processor disposed in the housing and one or more processors of the cloud.

* * * * *